US009056503B2

(12) United States Patent
Yoshida et al.

(10) Patent No.: US 9,056,503 B2
(45) **Date of Patent: *Jun. 16, 2015**

(54) RECORDING APPARATUS

(71) Applicant: SEIKO EPSON CORPORATION, Tokyo (JP)

(72) Inventors: Hiroshi Yoshida, Matsumoto (JP); Kenji Hatada, Shiojiri (JP); Ryo Hamano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/301,608

(22) Filed: Jun. 11, 2014

(65) Prior Publication Data

US 2014/0292884 A1 Oct. 2, 2014

Related U.S. Application Data

(63) Continuation of application No. 13/847,328, filed on Mar. 19, 2013, now Pat. No. 8,801,137.

(30) Foreign Application Priority Data

Jun. 22, 2012 (JP) ..... 2012-141279

(51) Int. Cl.
*B41J 29/38* (2006.01)
*B41J 15/04* (2006.01)
(Continued)

(52) U.S. Cl.
CPC *B41J 15/04* (2013.01); *B41J 15/18* (2013.01); *B41J 15/165* (2013.01)

(58) Field of Classification Search
CPC ..... B41J 15/04; B41J 15/165; B41J 15/18; B41J 15/20; B41J 15/22; B41J 15/16; B41J 15/005; B41J 15/02; B41J 15/042
USPC ..... 347/16, 104, 105
See application file for complete search history.

(56) References Cited

U.S. PATENT DOCUMENTS 6,340,254 B1 1/2002 Ono
6,880,991 B2 4/2005 Tsuruta et al.
(Continued)

FOREIGN PATENT DOCUMENTS

JP 2009-242048 10/2009
JP 2009-255496 11/2009
(Continued)

OTHER PUBLICATIONS

U.S. Appl. No. 13/847,328, filed Apr. 7, 2014, Notice of Allowance.

*Primary Examiner* — Juanita D Jackson
(74) *Attorney, Agent, or Firm* — Workman Nydegger

(57) ABSTRACT

A recording apparatus includes: a first driving unit that rotates a roll member; a second driving unit that drives a transport unit that transports a medium of the roll member; and a control unit that executes a first process for measuring a load occurring when transporting the medium while rotating the roll member 1/N rotations in a transport direction of the medium by driving the first driving unit while the second driving unit is stopped, and after executing the first process, executes a second process for rotating the roll member 1/N rotations in a opposite direction as the transport direction by driving the first driving unit while the second driving unit is stopped and then rotating the roll member 1/N rotations in the transport direction by driving the first driving unit and the second driving unit.

4 Claims, 10 Drawing Sheets

(51) Int. Cl.
*B41J 15/18* (2006.01)
*B41J 15/16* (2006.01)

(56) References Cited

U.S. PATENT DOCUMENTS

| | | | | |
|---|---|---|---|---|
| 8,147,023 | B2 | 4/2012 | Hatada et al. | |
| 8,328,318 | B2 | 12/2012 | Igarashi et al. | |
| 8,801,137 | B2 * | 8/2014 | Yoshida et al. | 347/16 |
| 2009/0245912 | A1 | 10/2009 | Igarashi et al. | |
| 2012/0012634 | A1 | 1/2012 | Hatada et al. | |

FOREIGN PATENT DOCUMENTS

| | | |
|---|---|---|
| JP | 2009-263044 | 11/2009 |
| JP | 2009-280398 | 12/2009 |
| JP | 2010-052379 | 3/2010 |
| JP | 2010-111057 | 5/2010 |
| JP | 2012-20851 | 2/2012 |

* cited by examiner

RECORDING APPARATUS

CROSS-REFERENCE TO RELATED APPLICATIONS

This application is a Continuation of U.S. patent application Ser. No. 13/847,328, filed Mar. 19, 2013, now U.S. Pat. No. 8,801,137, which claims priority to Japanese Patent Application No. 2012-141279, filed Jun. 22, 2012, which applications are expressly incorporated by reference herein.

BACKGROUND

1. Technical Field

The present invention relates to recording apparatuses.

2. Related Art

Some recording apparatuses record images onto a roll member medium (for example, "roll paper") onto which is wrapped a band-shaped. Roll members used in large-format recording apparatuses are heavy, and produce a significant load when pulling out and transporting the paper. For this reason, there is a risk of the paper tearing if the paper is taken out and transported using only the driving force of a transport unit (for example, a "transport roller"). Accordingly, an apparatus has been proposed in which a roll motor for rotationally driving a roll member is provided and the paper is transported by driving the transport roller and by also driving the roll motor.

Meanwhile, the load when taking out and transporting the paper decreases as the roll member continues to be used. Accordingly, if the paper is always transported at a constant driving force, there is a risk that the paper will loosen between the transport roller and the roll member. Accordingly, a method has been proposed that measures a load when supplying a roll member when the driving of a transport roller is stopped (that is, a load exerted on a roll motor) and controls the driving of the roll motor based on the result of the measurement, so that a predetermined tension is always applied to the paper.

JP-A-2009-242048 is an example of the related art.

However, because roll members used in large-format recording apparatuses are heavy, if, for example, the roll member is set in the apparatus and left for a long period of time, there is a risk that the central area of the roll member in the axial direction thereof will sag under its own weight. If this occurs, the center of gravity of the roll member will deviate from the rotational center, and the load will fluctuate significantly during each rotation of the roll member. In other words, the load will fluctuate depending on the angle of the roll member. If the roll member is nevertheless only rotated a small amount (for example, only ¼ rotation) when measuring the load, there is the risk that a skewed value will be measured for the load. On the other hand, if the roll member is greatly rotated all at once (for example, one full rotation) when measuring the load, the paper will sag significantly around the roll member. If this occurs, there is a risk that the areas of the sagging paper will make contact with peripheral members and the paper will be damaged as a result.

SUMMARY

It is an advantage of some aspects of the invention to provide a recording apparatus that suppresses a medium from sagging around a roll member when taking a measurement regarding a load, while reducing the influence of load fluctuations caused by differences in the angle of the roll member.

A recording apparatus according to one aspect of the invention includes: a recording unit that records onto a medium; a first driving unit that rotates a roll member around which the medium is wrapped; a transport unit, located downstream from the roll member in a transport direction of the medium, that transports the medium; a second driving unit that drives the transport unit; and a control unit that executes a first process for measuring a load occurring when transporting the medium while rotating the roll member 1/N rotations in a rotation direction employed when transporting the medium downstream by driving the first driving unit while the second driving unit is stopped, and after executing the first process, executes a second process for first rotating the roll member 1/N rotations in the opposite direction as the rotation direction by driving the first driving unit while the second driving unit is stopped and then rotating the roll member 1/N rotations in the rotation direction while transporting the medium downstream by driving the first driving unit and the second driving unit, the control unit executing the first process and the second process at least N/2 times.

Other features of the invention will be made clear by the descriptions in this specification and the appended drawings.

BRIEF DESCRIPTION OF THE DRAWINGS

The invention will be described with reference to the accompanying drawings, wherein like numbers reference like elements.

FIG. 3A is a diagram illustrating a relationship between a rotational velocity and a load, whereas

DESCRIPTION OF EXEMPLARY EMBODIMENTS

Outline of the Disclosure

Figure 1:
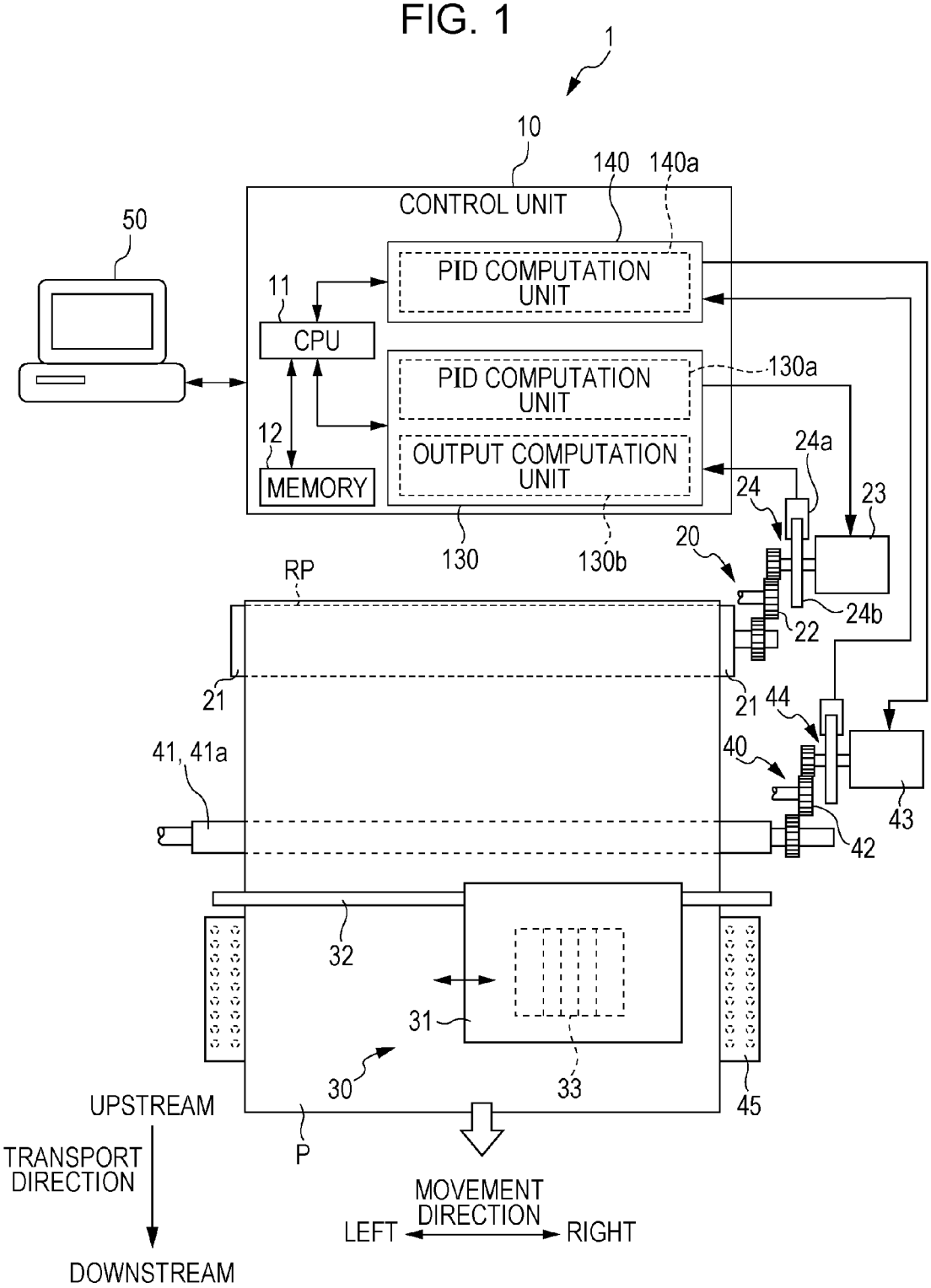
FIG. 1 is a diagram illustrating an example of the overall configuration of a printing system.

At least the following will be made clear through the descriptions in this specification and the content of the appended drawings.

That is, a recording apparatus includes: a recording unit that records onto a medium; a first driving unit that rotates a roll member in which the medium is wrapped; a transport unit, located downstream from the roll member in a transport direction of the medium, that transports the medium; a second driving unit that drives the transport unit; and a control unit that executes a first process for measuring a load occurring when transporting the medium while rotating the roll member 1/N rotations in a rotation direction employed when transporting the medium downstream by driving the first driving unit while the second driving unit is stopped, and after executing the first process, executes a second process for first rotating the roll member 1/N rotations in the opposite direction as the rotation direction by driving the first driving unit while the second driving unit is stopped and then rotating the roll member 1/N rotations in the rotation direction while transporting the medium downstream by driving the first driving unit and the second driving unit, the control unit executing the first process and the second process at least N/2 times.

According to this recording apparatus, a control value of the first driving unit (example: actual motor output value) that reduces the influence of load fluctuations resulting from differences in the angle of the roll member can be obtained, and the medium can be suppressed from sagging around the roll member when measuring a load.

In the stated recording apparatus, the control unit executes a third process for causing the transport unit to transport, upstream in the transport direction, an amount of the medium that is taken up when the roll member is rotated 1/N rotations in the opposite direction, by driving the second driving unit while the first driving unit is stopped, and after executing the third process, executes a fourth process for measuring the load while rotating the roll member 1/N rotations in the opposite direction by driving the first driving unit while the second driving unit is stopped.

According to this recording apparatus, a control value of the first driving unit (example: actual motor output value) that reduces the influence of load fluctuations resulting from differences in the angle of the roll member can be obtained, and the medium can be suppressed from sagging around the roll member when measuring a load. In addition, the amount of the medium transported downstream by the transport unit and the amount of the medium taken up by the roll member can be reduced, which makes it possible to reduce slanting (skew), loosening, and so on of the medium.

In the stated recording apparatus, a period in which the roll member makes 1/N rotations includes an acceleration period in which a velocity of the first driving unit accelerates to a constant velocity, a constant velocity period in which the first driving unit is driven at the constant velocity, and a deceleration period spanning until the first driving unit is stopped; and the control unit measures the load during the constant velocity period.

According to this recording apparatus, a load based on a specified velocity can be obtained.

In the stated recording apparatus, the control unit sets a velocity at which the first driving unit rotates the roll member 1/N rotations when measuring the load to a first velocity and to a second velocity that is higher than the first velocity in an alternating manner.

According to this recording apparatus, it is possible to obtain a relationship between a load and a velocity that reduces the influence of load fluctuations resulting from differences in the angle of the roll member.

Printing System

An embodiment will now be described using, as an example, a printing system in which an ink jet printer (called a "printer" hereinafter) and a computer are connected, where the printer serves as a "recording apparatus".

FIG. 1 is a diagram illustrating an example of the overall configuration of the printing system. A printer 1 according to this embodiment uses a roll member RP in which continuous band-shaped paper P (corresponding to a medium) is wound upon in order to print (record) images onto the comparatively large-sized paper P (for example, a size greater than or equal to A2 in the JIS standard). Note that the medium is not limited to the paper P, and may be, for example, cloth, a plastic film, or the like. The printer 1 includes a controller 10, a roll driving mechanism 20, a carriage driving mechanism 30, and a paper transport mechanism 40. Meanwhile, the printer 1 is communicably connected to a computer 50, and print data for printing images is sent from the computer 50 to the printer 1 (the controller 10). Note that the printer 1 is not limited to being connected to the computer 50, and, for example, the printer 1 itself may create the print data.

The roll driving mechanism 20 is a mechanism for rotating the roll member RP, and includes rotating holders 21, a geartrain 22, a roll motor 23 (example: DC motor), and a rotation detection unit 24. The rotating holders 21 are inserted from openings on both ends of the hollow roll member RP, and are thus provided as a pair in order to support the roll member RP from both ends. The roll motor 23 applies a driving force (rotational force) to the rotating holder 21 located at one end (the right end in a movement direction) via the geartrain 22. In other words, the roll member RP rotates as a result of the driving of the roll motor 23 (corresponding to a first driving unit). The rotation detection unit 24 is a unit for detecting a rotation amount of the roll motor 23, or in other words, a rotation amount of the roll member RP. In this embodiment, the rotation detection unit 24 is assumed to be a rotary encoder. The rotation detection unit 24 includes a disk-shaped scale 24*b* and a sensor 24*a*. The disk-shaped scale 24*b* is provided with multiple slits at constant intervals along the circumferential direction thereof, and rotates along with the roll motor 23 (the roll member RP). The sensor 24*a* includes a light-emitting element and a light-receiving element. The light-receiving element sequentially detects light from the light-emitting element that has passed through the slits of the rotating disk-shaped scale 24*b*, and the rotation detection unit 24 outputs, to the controller 10, a pulse signal based on the results of that detection. The controller 10 obtains the rotation amount of the roll member RP (the roll motor 23) based on the pulse signal from the rotation detection unit 24.

The carriage driving mechanism 30 is a mechanism for printing images onto the paper P that has been taken out from the roll member RP, and includes a carriage 31, a carriage shaft 32, a print head 33 (corresponding to a recording unit that records onto a medium), a carriage motor (not shown), and the like. The carriage 31 is capable of moving in the movement direction along the carriage shaft 32 as a result of driving performed by the carriage motor. The print head 33, which is capable of ejecting ink droplets from nozzles, is provided on a bottom surface (that is, a surface that faces the paper P) of the carriage 31. Note that the system for ejecting ink from the nozzles may be, for example, a piezoelectric system in which ink is ejected by applying voltages to driving elements (piezoelectric elements) and causing ink chambers to expand/contract; a thermal system in which bubbles are produced within the nozzles using a thermal element and the ink is ejected as a result of those bubbles; a magnetostrictive system that employs a magnetostrictive device; a mist system that controls a mist using electrical fields; or the like. Meanwhile, ink supplied to the print head 33 from an ink cartridge may be any type of ink, such as a dye-based ink, a pigment-based ink, or the like.

Figure 5A:
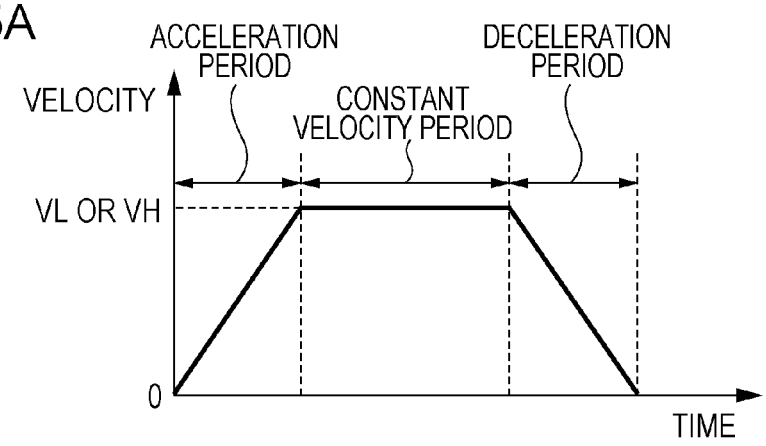
FIG. 5A is a diagram illustrating a velocity table.
Figure 5B:
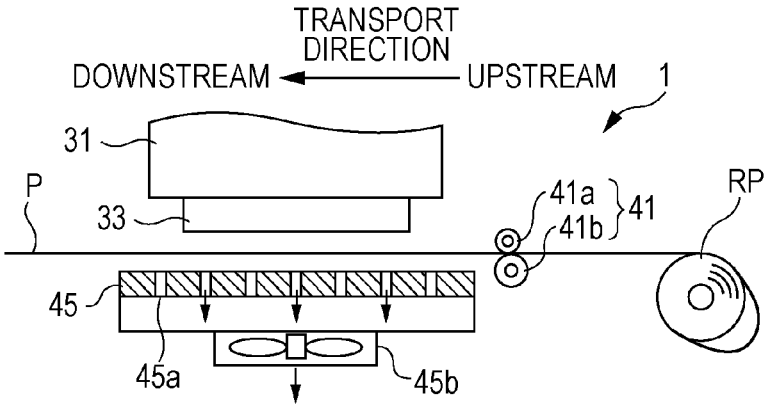
FIG. 5B is an overall cross-sectional view of a printer.

The paper transport mechanism 40 is a mechanism for transporting the paper P that has been taken out from the roll member RP from an upstream side (a supply side) to a downstream side (a discharge side) in a transport direction, and includes a transport roller pair 41, a geartrain 42, a PF motor 43 (example: DC motor), a rotation detection unit 44, and a platen 45. The transport roller pair 41 (corresponding to a transport unit) is located downstream from the roll member RP in the transport direction, and transports the paper P. Meanwhile, as shown in FIG. 5B, the transport roller pair 41 includes a transport driving roller 41*a* and a transport slave roller 41*b*, and transports the paper P downstream in the transport direction while pinching the paper P between the stated rollers. The PF motor 43 imparts a driving force (a rotational force) on the transport driving roller 41*a* via the geartrain 42. In other words, the transport roller pair 41 rotates under the driving of the PF motor 43 (corresponding to a second driving unit). The rotation detection unit 44 is a unit for detecting a rotation amount of the PF motor 43, or in other words, a rotation amount of the transport driving roller 41*a*, and in this embodiment, is the same type of rotary encoder as the rotation detection unit 24 of the roll driving mechanism 20. The controller 10 obtains the rotation amount of the PF motor 43 (the transport driving roller 41*a*) based on a pulse signal from the rotation detection unit 44.

Meanwhile, the platen 45 is provided downstream from the transport roller pair 41, in a location that faces the surface of the print head 33 in which the nozzles are provided; the paper P is supported from its rear surface by the platen 45. Furthermore, as shown in FIG. 5B, suction holes 45*a* are provided in the platen 45, and a suction fan 45*b* is provided below the platen 45. Accordingly, air is sucked from the side on which the print head 33 is located through the suction holes 45*a* as a result of the suction fan 45*b* operating, and thus the paper P can be sucked and held on the platen 45.

The controller 10 is a unit for performing the overall control of the printer 1, and includes a CPU 11, a memory 12, a roll motor control unit 130, and a PF motor control unit 140. The roll motor control unit 130 is a unit for controlling the driving of the roll motor 23; the roll motor control unit 130 includes a PID computation unit 130*a* and an output computation unit 130*b*, and obtains the pulse signal from the rotation detection unit 24. The PF motor control unit 140 is a unit for controlling the driving of the PF motor 43; the PF motor control unit 140 includes a PID computation unit 140*a*, and obtains the pulse signal from the rotation detection unit 44. Note that the printer 1 also includes various types of sensors such as a paper width detection sensor for detecting the width of the paper P and so on, and the controller 10 carries out control based on detection results from the various types of sensors.

In the printer 1 configured in this manner, the controller 10 alternately repeats an ejection operation, in which ink droplets are ejected from the nozzles while the print head 33 is moved in the movement direction by the carriage 31, and a transport operation, in which the paper P is taken out from the roll member RP and transported downstream in the transport direction. As a result, dots are formed in given locations in earlier ejection operations, and then dots are formed in different locations in later ejection operations; consequently, a two-dimensional image is printed on the paper P.

Driving Control of PF Motor 43

Figure 2:
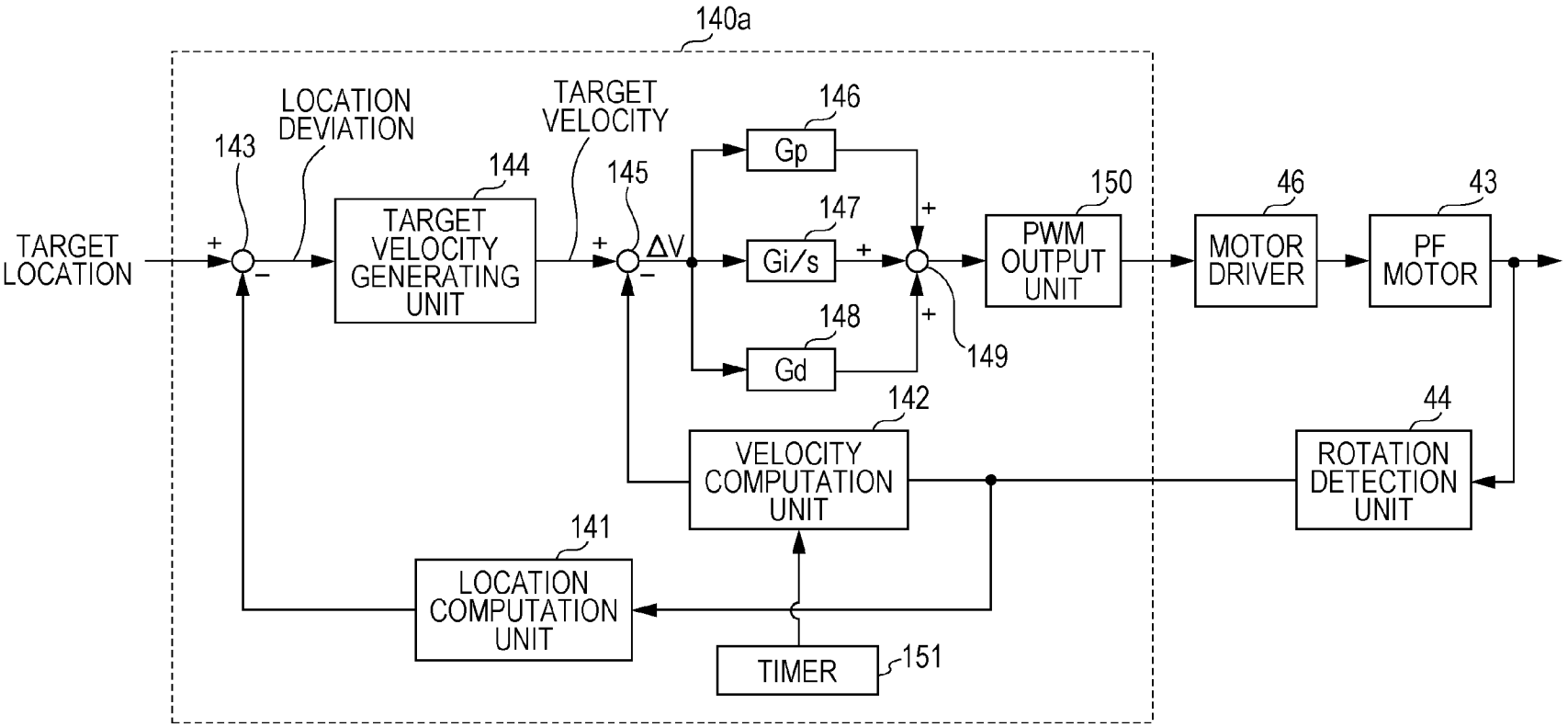
FIG. 2 is a block diagram illustrating the overall configuration of a PID computation unit.

FIG. 2 is a block diagram illustrating the overall configuration of the PID computation unit 140*a* in the PF motor control unit 140. The PID computation unit 140*a* is a unit for carrying out PID control on the rotational velocity of the PF motor 43, and as a result controls the transport velocity, transport amount, and so on of the paper P. The PID computation unit 140*a* includes a position computation unit 141, a velocity computation unit 142, a first subtracter 143, a target velocity generation unit 144, a second subtracter 145, a proportional element 146, an integrating element 147, a differential element 148, an adder 149, a PWM output unit 150, and a timer 151.

The position computation unit 141 calculates the rotation amount of the PF motor 43 by counting the edges in the pulse signal inputted from the rotation detection unit 44 (the rotary encoder). Meanwhile, the velocity computation unit 142 counts the edges in the pulse signal inputted from the rotation detection unit 44 and calculates the rotational velocity of the PF motor 43 based on a signal regarding time measured by the timer 151.

The first subtracter 143 outputs a position deviation by subtracting information regarding a target position (a target stop position) from the controller 10, from information regarding a current position outputted from the position computation unit 141 (that is, the rotation amount of the PF motor 43). The target velocity generation unit 144 outputs, to the second subtracter 145, information regarding a target velocity based on the position deviation inputted from the first subtracter 143. Note that the information regarding the target velocity based on the position deviation relates to, for example, a velocity table such as that shown in FIG. 5A, which will be mentioned later.

The second subtracter 145 calculates a velocity deviation ΔV by subtracting a current velocity from the target velocity of the PF motor 43, and outputs the velocity deviation ΔV to the proportional element 146, the integrating element 147, and the differential element 148. The proportional element 146, the integrating element 147, and the differential element 148 calculate a proportional control value QP(j), an integrating control value QI(j), and a differential control value QD(j), shown below, at a time j, based on the inputted velocity deviation ΔV.

$$QP(j)=\Delta V(j)\times Kp \quad \text{(Formula 1)}$$

$$QI(j)=QI(j-1)+\Delta V(j)\times Ki \quad \text{(Formula 2)}$$

$$QD(j)=\{\Delta V(j)-\Delta V(j-1)\}\times Kd \quad \text{(Formula 3)}$$

Here, j represents time, Kp represents a proportional gain, Ki represents an integration gain, and Kd represents a differential gain.

The adder 149 adds the respective control values outputted from the proportional element 146, the integrating element 147, and the differential element 148, and outputs the added value Qpid (=QP+QI+QD) to the PWM output unit 150. The PWM output unit 150 outputs a duty value based on the control value Qpid outputted from the adder 149 to a motor driver 46. The motor driver 46 controls the driving of the PF motor 43 through PWM control (pulse width modulation control) based on the inputted duty value. As a result, the rotational velocity of the PF motor 43 is controlled to take on the target velocity, and consequently, the paper P is transported by a target amount.

Driving Control of Roll Motor 23

A Comparative Example

Figure 3A:
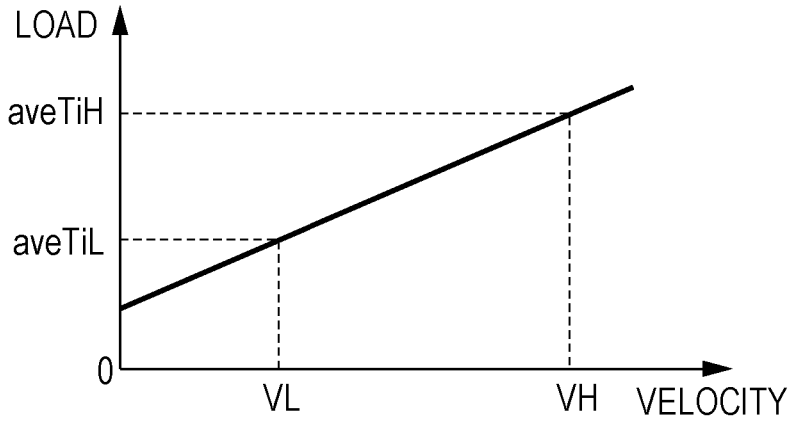

FIG. 3A is a diagram illustrating a relationship between the rotational velocity of the roll motor 23 and a load. In FIG. 3A, the horizontal axis represents the rotational velocity of the roll motor 23, whereas the vertical axis represents a load acting on the roll motor when the roll motor 23 is driven alone without driving the PF motor 43. In the case where an image is to be printed on a comparatively large-sized paper P (roll member RP), as is the case with the printer 1 according to this embodiment, the roll member RP is heavy, and thus there is a significant load when taking out and transporting the paper P from the roll member RP. Accordingly, there is a risk that the paper P will tear if an attempt is made to take out and transport the paper P from the roll member RP using only the transport force of the transport roller pair 41, or in other words, only the driving force of the PF motor 43. Accordingly, in the printer 1 according to this embodiment, the roll motor 23 for rotationally driving the roll member RP is provided, and the paper P is taken out and transported from the roll member RP by driving the roll motor 23 along with the PF motor 43.

However, the diameter and the weight of the roll member RP will decrease as the roll member RP is used, and thus the load exerted when taking out and transporting the paper P will also decrease as a result. Accordingly, if the driving force of the roll motor 23 is set to be constant, the paper P will loosen between the transport roller pair 41 and the roll member RP, transport errors will occur, and so on due to the change in the weight of the roll member RP, and this can consequently lead to a decrease in the quality of the printed image.

Accordingly, in a comparative example, a relationship between the load acting on the roll motor 23 when the roll motor 23 is driven alone without driving the PF motor 43 and the rotational velocity of the roll motor 23 (FIG. 3A) is measured, for example, prior to the start of a print job. The paper P is transported by controlling the driving of the roll motor 23 based on a result of the measurement. Doing so makes it possible to reduce the influence of load fluctuations caused by changes in the weight of the roll member RP.

Specifically, the CPU 11 measures a load TiL in a period where the roll member RP is rotated ¼ rotation in a forward direction by driving the roll motor 23 at a low velocity VL while the PF motor 43 is stopped, and measures a load TiH in a period where the roll member RP is rotated ¼ rotation in the forward direction by driving the roll motor 23 at a high velocity VH while the PF motor 43 is stopped. Note that in the following descriptions, of the rotation directions of the roll member RP (and the PF motor 43 and roll motor 23), the direction in which the paper P is transported downstream will be referred to as the "forward direction" and the direction in which the paper P is taken up onto the roll member RP will be referred to as a "reverse direction".

Meanwhile, the driving control of the roll motor 23 when measuring the load is carried out as PID control by the PID computation unit 130*a* in the roll motor control unit 130. Because the configuration of the PID computation unit 130*a* is the same as the configuration of the PID computation unit 140*a* in the PF motor control unit 140, descriptions thereof will be omitted. Here, control values QI outputted from an integrating element (for reference: 147 in FIG. 2) while the roll motor 23 is being driven at the respective velocities VL and VH are taken as the loads. The CPU 11 then calculates average values aveTiL and aveTiH of the plurality of obtained control values QI for each driving velocity (VL, VH) of the roll motor 23. As a result, a relationship between the load and the rotational velocity is obtained, as shown in FIG. 3A.

When the paper P is transported, the output computation unit 130*b* calculates an "actual motor output value Dx' (a duty value during PWM control)" through the following Formula 4, based on the relationship between the load and the rotational velocity (FIG. 3A). In Formula 4, "Duty(r0)" represents a duty value necessary for driving the roll motor 23 at a velocity Vn, "Duty(f)" represents a duty value necessary for causing a specified tension "F" to act on the paper P so that the paper P does not loosen, "a and b" represent coefficients found based on the relationship between the load and the rotational velocity, "r" represents the radius of the roll member RP, "M" represents the axle ratio of the geartrain 22, "Duty(max)" represents a maximum value of the duty value, and "Ts" represents a starting torque of the roll motor 23.

$$Dx' = \text{Duty}(r0) - \text{Duty}(f) \qquad \text{(Formula 4)}$$
$$= aVn + b - (Fxr/M) \times \text{Duty(max)}/Ts$$

The coefficients a and b for the Duty(r0) are found through the following Formulas 5 and 6 based on the relationship between the load and the rotational velocity (FIG. 3A).

$$a = (\text{ave}TiH - \text{ave}TiL)/(VH - VL) \qquad \text{(Formula 5)}$$

$$b = \text{ave}TiL - (\text{ave}TiH - \text{ave}TiL) \times VL/(VH - VL) \qquad \text{(Formula 6)}$$

Note that the roll motor 23 is pulled via the paper P as a result of the driving of the PF motor 43. Accordingly, the roll motor 23 and the PF motor 43 are driven at the same velocity Vn. In addition, a current rotational velocity Vn of the roll motor 23 is found based on the pulse signal from the rotation detection unit 24. The radius r of the roll member RP may be found, for example, through estimation based on the weight or the like of the roll member RP, by being obtained from a sensor, by being estimated based on a usage amount (remaining amount) of the paper P, or through another method not mentioned here.

The actual motor output value Dx' calculated in this manner by the output computation unit 130*b* is inputted into a motor driver (not shown) of the roll motor 23. The motor driver controls the driving of the roll motor 23 through PWM control based on the inputted actual motor output value Dx' (duty value). Doing so makes it possible to reduce the influence of load fluctuations caused by changes in the weight of the roll member RP when transporting the paper P.

Problem with Comparative Example

Figure 3B:
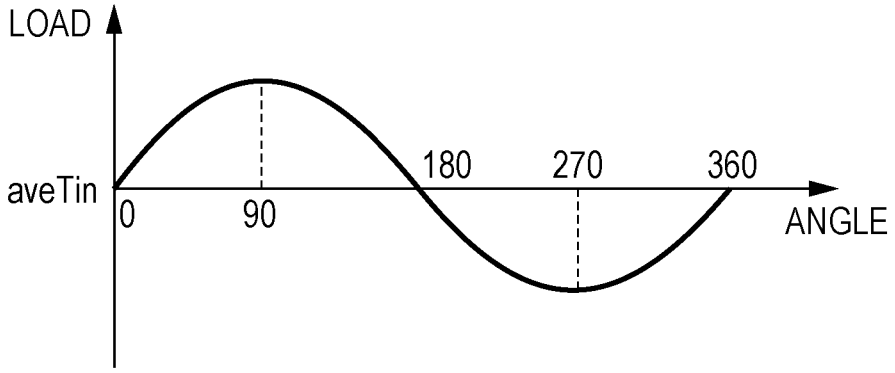
FIG. 3B is a diagram illustrating a load fluctuation occurring while a roll member makes one rotation.

FIG. 3B is a diagram illustrating a load fluctuation occurring when the roll member RP is rotated once by driving the roll motor 23 at a given velocity Vn. The horizontal axis in FIG. 3B represents a rotation angle of the roll member RP, whereas the vertical axis represents the load acting on the roll motor 23. If the roll member RP that is used is heavy, as is the case with the printer 1 according to the aforementioned embodiment, not only will there be a problem that the load will be great when taking out and transporting the paper P from the roll member RP, but there will also be a problem in that, for example, in the case where the roll member RP is left supported at both ends by the rotating holders 21 for a long period of time, the central area of the roll member RP in the axial direction thereof will sag under its own weight. If this occurs, the center of gravity of the roll member RP will be skewed from the rotational center thereof, and the load acting on the roll motor 23 will fluctuate as the roll member RP makes a single rotation. In FIG. 3B, the load fluctuates in sine curve form in accordance with the angle of the roll member RP.

Accordingly, if the roll member RP is only rotated ¼ rotation when measuring the load as with the comparative example, only a skewed value will be measured for the load, based on the angle of the roll member RP; consequently, the average values aveTiH and aveTiL will also be skewed values. In other words, a value that is skewed from the average value of the load obtained when rotating the roll member RP a single rotation (an aveTin in FIG. 3B) will be calculated as the average value. If the driving of the roll motor 23 is controlled according to the skewed average value, the specified tension F cannot be continuously applied to the paper P. As a result, the paper P will sag, transport errors will occur, or the like, which in turn will result in the quality of the printed image degrading.

Next, it is assumed that the roll member RP is rotated a full rotation all at once when measuring the load in order to calculate the average value of the load obtained when rotating the roll member RP a single rotation (aveTin in FIG. 3B). If this is the case, the PF motor 43 is stopped when measuring the load, and thus the paper P will not be transported downstream by the transport roller pair 41; consequently, one rotation's worth of the paper P will significantly sag around the roll member RP. If this occurs, there is a risk that the areas of the sagging paper will make contact with peripheral members and the paper P will be damaged as a result. There is also a risk that a user who sees the paper P significantly sag around the roll member RP will mistakenly think that a problem has arisen in the printer 1.

Accordingly, the following working examples aim to suppress the paper P from sagging around the roll member RP when measuring the load, while suppressing the influence of load fluctuations resulting from differences in the angle of the roll member RP.

Driving Control of Roll Motor 23

Working Example

In this working example, when transporting the paper P, the driving of the roll motor 23 is controlled according to an actual motor output value Dx that incorporates load fluctuations (FIG. 3B) resulting from differences in the angle of the roll member RP. Accordingly, in this working example, the CPU 11 carries out, in accordance with the program stored within the memory 12, a "measurement process" that acquires the relationship between the load and the rotational velocity (FIG. 3A) and a correction amount provided in response to the load fluctuations (FIG. 3B) occurring during a single rotation of the roll member.

Measurement Process

First Working Example

Figure 4:
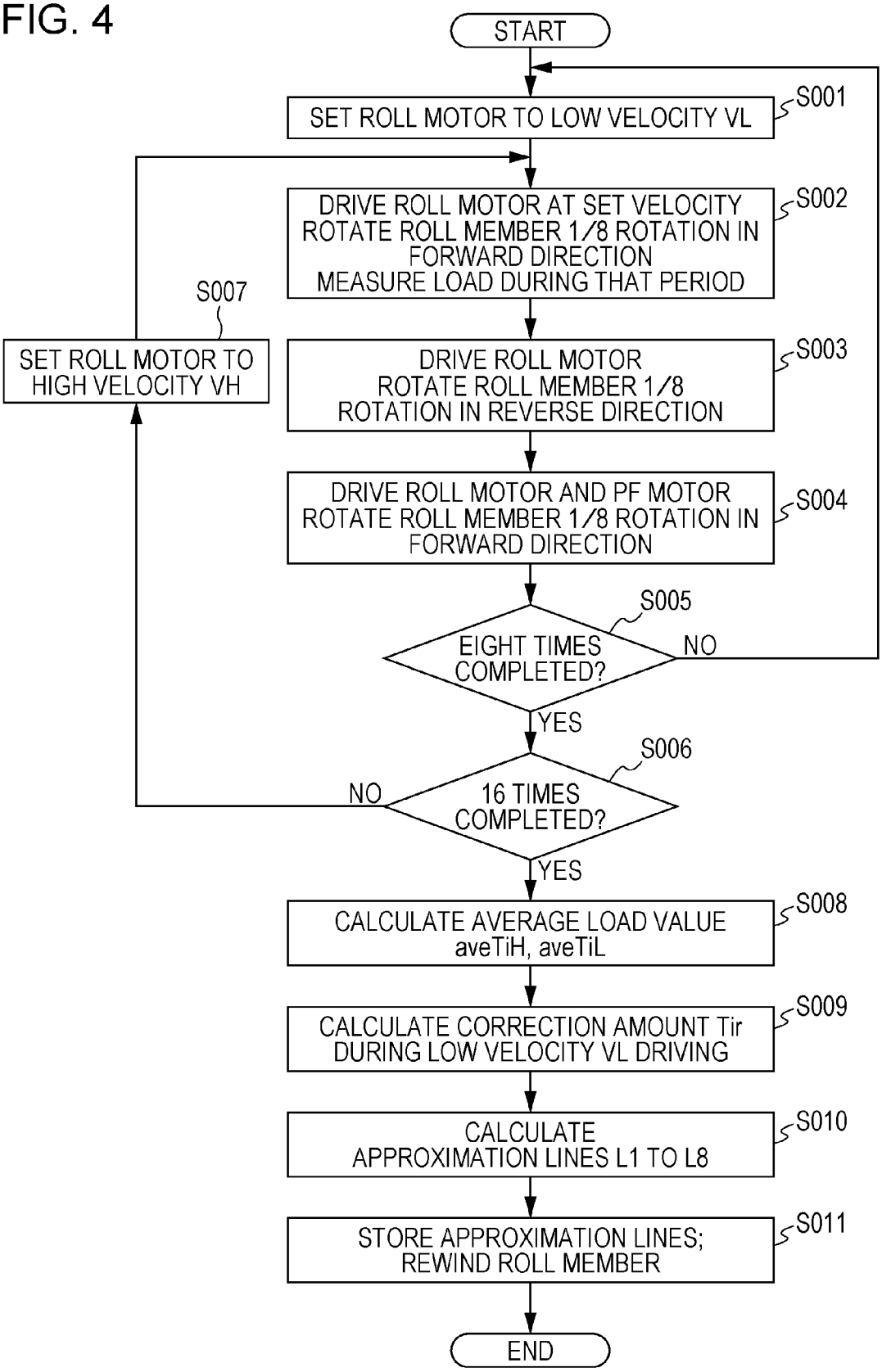
FIG. 4 is a flowchart illustrating a measurement process according to a first working example.
Figure 5C:
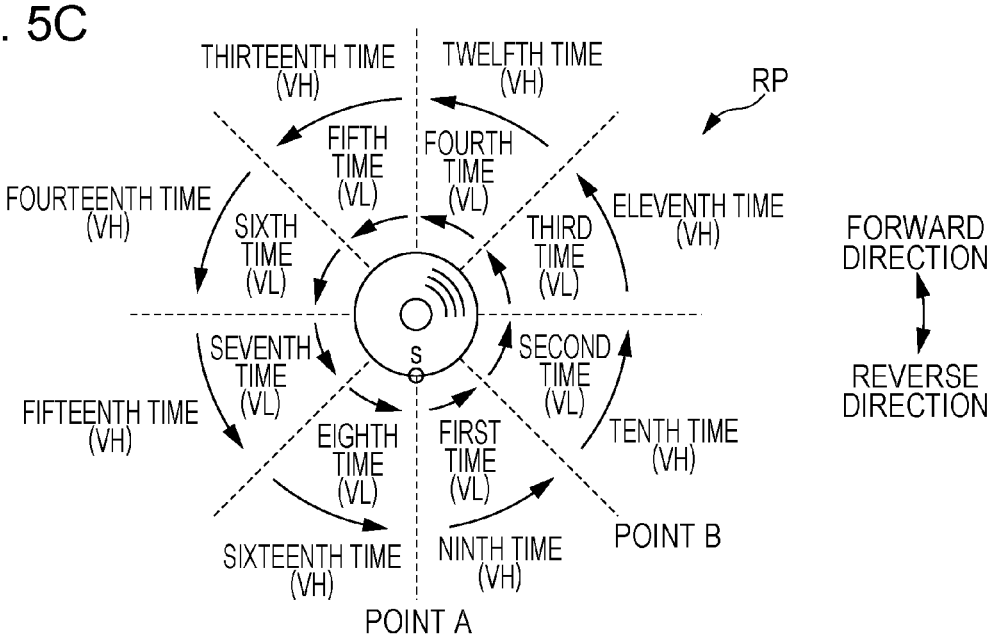
FIG. 5C is a diagram illustrating a relationship among the number of load measurements, a roll member rotation amount, and a roll motor rotational velocity.
Figure 6A:
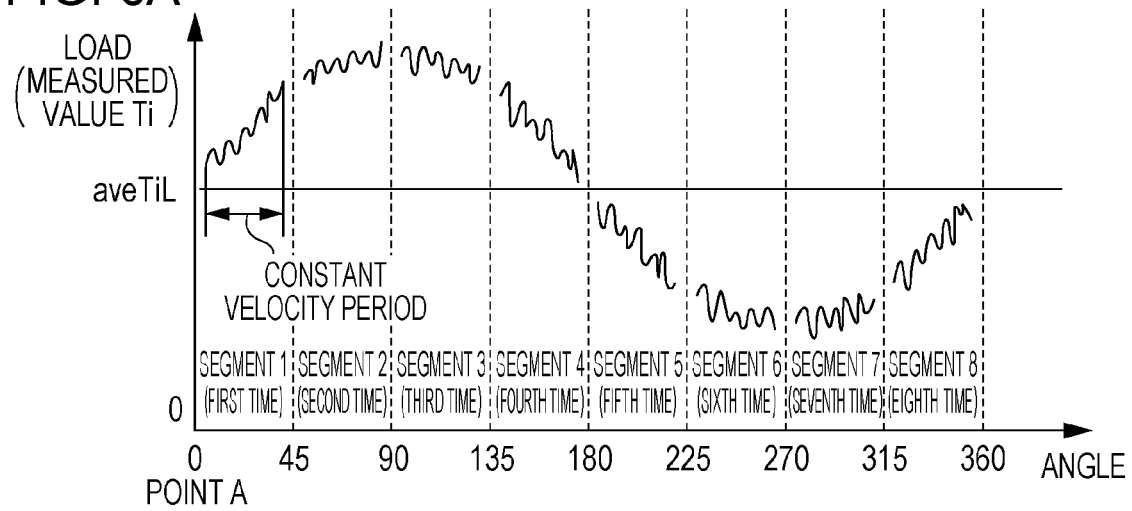
FIGS. 6A through 6C are diagrams illustrating processes for calculating approximation lines.
Figure 6B:
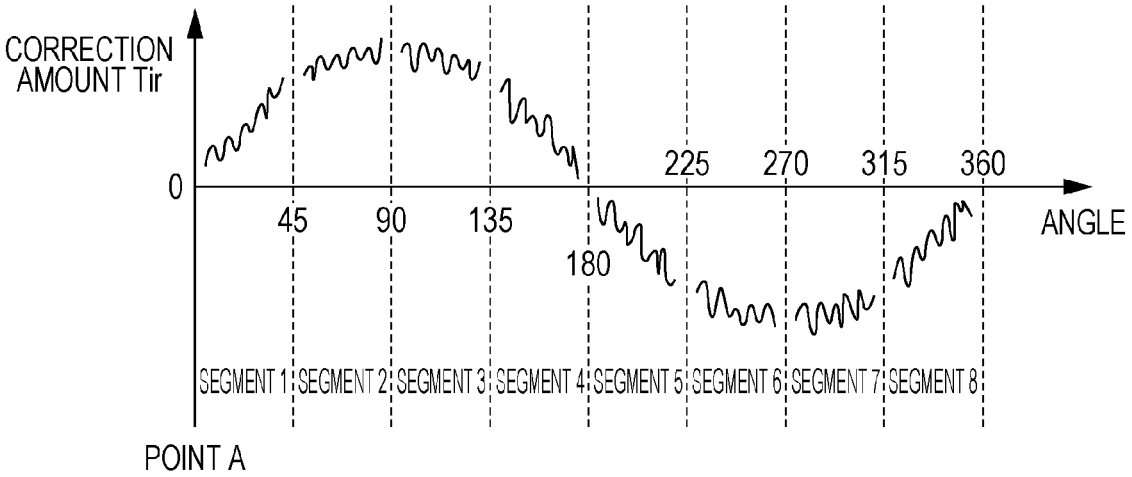
Figure 6C:
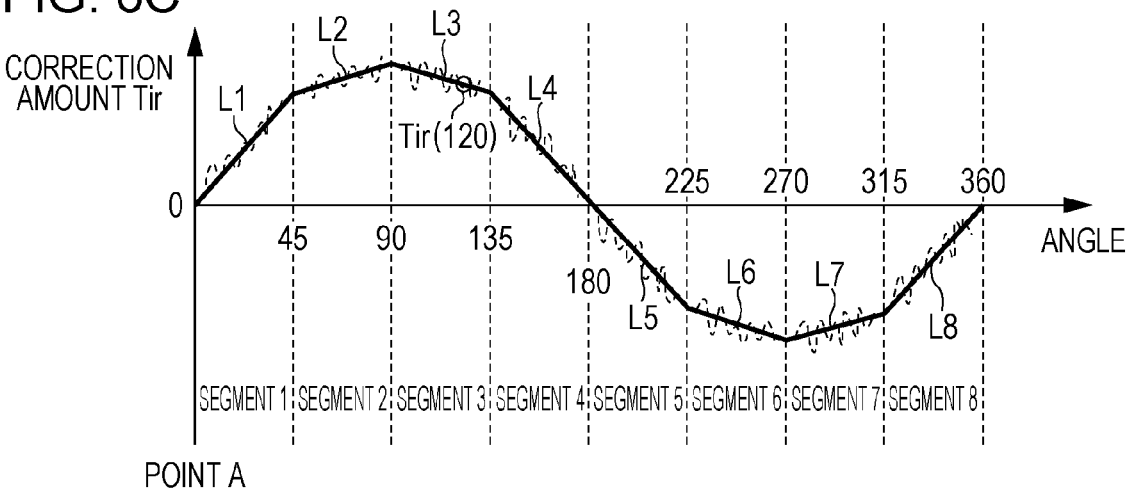

FIG. 4 is a flowchart illustrating the measurement process according to a first working example. FIG. 5A is a diagram illustrating a velocity table for the roll motor 23, FIG. 5B is an overall cross-sectional view of the printer 1 seen from the movement direction of the print head 33, and FIG. 5C is a diagram illustrating a relationship among the number of load measurements, the roll member RP rotation amount, and the roll motor 23 rotational velocity. Note that the horizontal axis in FIG. 5A represents time, and the vertical axis represents the rotational velocity of the roll motor 23. FIGS. 6A to 6C are diagrams illustrating a process for calculating approximation lines L1 to L8 for the load fluctuations. Note that the horizontal axes in FIGS. 6A to 6C represent angles at which a reference point s of the roll member RP (see FIG. 5C) has rotated in the forward direction from a point A (0°). In addition, the space from 0° to 360° is divided into eight segments, and every 45° segment is referred to as segment 1, segment 2, and so on up to segment 8, in order from the smallest angle. The vertical axis in FIG. 6A represents a load measurement value Ti, whereas the vertical axes in FIGS. 6B and 6C represent a correction amount Tir for the load.

In the measurement process, the CPU 11 first sets the rotational velocity of the roll motor 23 to the low velocity VL (S001). Note that the low velocity VL is taken as the rotational velocity of the roll motor 23 used when transporting the paper P during an actual printing process. Next, the CPU 11 drives the roll motor 23 at a set velocity using the PID computation unit 130*a* in the roll motor control unit 130 while the PF motor 43 is stopped, rotates the roll member RP ⅛ rotation (45° rotation) in the forward direction, and measures the load acting on the roll motor 23 during this period (that is, takes a measurement regarding the load) (S002). As a result of this process, the reference point s of the roll member RP moves from being positioned at the point A to being positioned at a point B.

Due to the roll member RP rotating ⅛ rotation in the forward direction, the paper P will sag around the roll member RP, as illustrated in FIG. 5B. However, in this working example, the roll member RP is only rotated ⅛ rotation at a time, and thus the amount by which the paper P sags down can be reduced (reduced to ⅛) as compared to the case where the roll member RP is rotated a full rotation all at once, as in the comparative example. Accordingly, it is less apparent that the paper P is sagging around the roll member RP, and the user can be prevented from mistakenly thinking that a problem has arisen. Furthermore, the areas of the sagging paper can be prevented from making contact with peripheral members and the paper P can be prevented from being damaged as a result.

Note that in the first working example, the measurement value Ti obtained at the Nth (example: first) load measurement is taken as the measurement value Ti for a segment N (example: segment 1) in the graph shown in FIG. 6A. Note also that the control value QI outputted from the integrating element in the PID computation unit 130*a* while the roll motor 23 is being driven is taken as a "load measured while rotating the roll member RP 1/N rotation by driving the roll motor 23 while the PF motor 43 is stopped (that is, a load acting on the roll motor 23 when the paper P is being transported)". However, the example is not limited thereto, and for example, the duty value of the PWM-controlled roll motor 23, a current value or voltage value of the roll motor 23, or the like may be taken as the load when transporting the paper P. Furthermore, a load measurement device may be attached to the roll motor 23, and the load of the roll motor 23 may be measured directly. Taking such measurements corresponds to taking measurements regarding the load.

Meanwhile, as shown in FIG. 5A, the period in which the roll member RP is being rotated ⅛ rotation in order to measure the load includes an acceleration period in which the roll motor 23 accelerates from a stopped state to a constant velocity (VL or VH), a constant velocity period in which the roll motor 23 is driven at a constant velocity, and a deceleration period in which the roll motor 23 decelerates from being driven at the constant velocity to a stopped state. Accordingly, the CPU 11 obtains the control value QI outputted from the integrating element within the PID computation unit 130*a* during the constant velocity period as the load.

Next, the CPU 11 rotates the roll member RP ⅛ rotation in the reverse direction by driving the roll motor 23 while the PF motor 43 is stopped (S003). In other words, the reference point s of the roll member RP is returned from being positioned at the point B to being positioned at the point A. As a result, the sagging of the paper P around the roll member RP that occurred when measuring the load (S002) is eliminated.

Next, by driving the PF motor 43 and the roll motor 23, the CPU 11 rotates the roll member RP ⅛ rotation in the forward direction while transporting the paper P downstream in the transport direction using the transport roller pair 41 (S004). As a result of this process, the reference point s of the roll member RP moves from being positioned at the point A to being positioned at a point B. Due to the stated process, the phase of the roll member RP can be shifted without causing the paper P to sag around the roll member RP. Accordingly, a paper amount equivalent to ⅛ rotation of the roll member is the maximum amount by which the paper will sag.

The CPU 11 then repeats the aforementioned processing (S002 to S004) eight times (S005). As a result, the roll member RP makes a single rotation in the forward direction over eight times, and as shown in FIG. 6A, a load fluctuation for a single rotation of the roll member when driving at the low velocity VL (that is, the measurement value Ti) is obtained.

Thereafter, the CPU 11 sets the rotational velocity of the roll motor 23 to the high velocity VH (S007) and once again repeats the aforementioned processing (S002 to S004) eight times. In other words, the load is measured a total of 16 times (S006). As a result, a load fluctuation for a single rotation of the roll member when driving at the high velocity VH (that is, the measurement value Ti) is also obtained, in the same manner as shown in FIG. 6A. Note that two roll member rotations' worth of the paper P is transported downstream by the transport roller pair 41 as a result of the 16 times the process of S004 is carried out.

Next, the CPU 11 calculates the average value of the load (the measurement value Ti) for each of the driving velocities (VL and VH) of the roll motor 23 (S008). In other words, the CPU 11 calculates an average value of the load measured eight times as the roll member RP is rotated ⅛ rotations at the low velocity VL (FIG. 6A) as a "low velocity load average value aveTiL" and calculates an average value of the load measured eight times as the roll member RP is rotated ⅛ rotations at the high velocity VH as a "high velocity load average value aveTiH". As a result, a relationship between the load and the rotational velocity (FIG. 3A) is obtained, in the same manner as in the comparative example. In this manner, in the first working example, the average values aveTiL and aveTiH of the load obtained by rotating the roll member RP a full rotation are calculated. Accordingly, the average values can be prevented from being calculated based on a skewed value for the load, or in other words, based only on a load occurring at some angles of the roll member RP, which in turn makes it possible to calculate an accurate average value and relationship between the load and the rotational velocity.

Next, the CPU 11 calculates, for each angle of the roll member RP, the correction amount Tir for the load when the roll motor 23 is driven at the low velocity VL (a velocity employed when performing an actual printing process) (S009). To do so, the CPU 11 subtracts the low velocity load average value aveTiL from the measurement value Ti of the load obtained during driving at the low velocity VL (FIG. 6A) ($Tir(\theta)=Ti(\theta)-aveTiL$). As a result, as shown in FIG. 6B, a load correction amount $Tir(\theta)$ based on each angle $\theta$ of the roll member RP during driving at the low velocity VL is calculated. Note that the angle $\theta$ corresponds to the angle to which the reference point s of the roll member RP is rotated in the forward direction from the point A. The correction amount for the load based on the angle $\theta$ of the roll member RP is not, however, calculated during driving at the high velocity VH.

Incidentally, the load (measurement value Ti) obtained from the integrating element is discrete, and loads are not obtained during the acceleration/deceleration periods of the roll motor 23 (FIG. 5A). Accordingly, the CPU 11 calculates the approximation lines L1 to L8 (approximation formulas) for each segment based on the calculated correction amount Tir, through the least-squares method (S010). As a result, as shown in FIG. 6C, eight approximation lines L1 to L8 are calculated, one every 45°. Accordingly, the correction amount $Tir(\theta)$ for the angles $\theta$ for which the load (measurement value Ti) could not be measured can also be calculated from the approximation lines L1 to L8. Note that the working example is not limited to calculating the approximation lines through the least-squares method on a segment-by-segment basis; for example, approximation formulas may be calculated every two segments, a single approximation formula may be calculated for eight segments, a polynomial approximation formula such as a two-dimensional approximated curve or the like may be calculated, approximation may be carried out using a sine function, or the like.

Finally, the CPU 11 stores the eight calculated approximation lines L1 to L8 in the memory 12. In addition, the CPU 11 drives the PF motor 43 and the roll motor 23 in the reverse direction, and takes up two roll member rotations' worth of the paper P onto the roll member RP (S011). As a result, the measurement process according to the first working example ends, and the printer 1 enters a state in which printing can be carried out.

As described above, in the measurement process according to the first working example, the CPU 11 (control unit) executes a process for measuring the load when the paper P is transported (S002, a first process) while rotating the roll member RP ⅛ rotation (1/N rotation) in the forward direction (that is, a rotation direction used when transporting the medium downstream) by driving the roll motor 23 (the first driving unit) at the low velocity VL while the PF motor 43 (the second driving unit) is stopped, and then executes a process for rotating the roll member RP ⅛ rotation in the forward direction while transporting the paper P downstream by driving the PF motor 43 and the roll motor 23 after first rotating the roll member RP ⅛ rotation in the reverse direction (the opposite direction as the rotation direction) by driving the roll motor 23 while the PF motor 43 is stopped (S003 and S004, a second process), performing these processes eight times (N/2 times=executing processes four or more times).

By doing so, sagging of the paper P around the roll member RP can be suppressed while obtaining load fluctuations (FIG. 6A) occurring when the roll member RP is rotated a full rotation by driving the roll motor 23 at the low velocity VL (that is, the velocity used when carrying out an actual printing process) without driving the PF motor 43. Accordingly, the paper P can be prevented from making contact with peripheral elements, and the user can be prevented from mistakenly thinking that a problem has occurred.

In addition, in the first working example, the velocity of the roll motor 23 is changed to the high velocity VH, and the same processes (the first process and the second process) are then executed eight times. Accordingly, the load fluctuations occurring when the roll member RP is rotated a full rotation by driving the roll motor 23 at the high velocity VH without driving the PF motor 43 can also be obtained.

Accordingly, it is possible to obtain accurate average values aveTiL and aveTiH and an accurate relationship between the load and the rotational velocity (FIG. 3A) based not on a skewed load occurring only at some angles for the roll member RP, but based instead on a load occurring over a full rotation of the roll member. Accordingly, the actual motor output value Dx can be calculated based on an accurate relationship between the load and the rotational velocity during driving control of the roll motor 23, which makes it possible to reduce the influence of load fluctuations resulting from differences in the angle of the roll member RP.

In addition, the correction amount Tir (approximation lines L1 to L8) can be obtained for the loads at each angle θ of the roll member RP during driving at the low velocity VL, based on the load occurring during a full rotation of the roll member during driving at the low velocity VL. By driving the roll motor 23 at the actual motor output value Dx that incorporates the correction amount Tir, the influence of load fluctuations resulting from differences in the angle of the roll member RP can be further reduced. As a result, the specified tension F can be continuously applied to the paper P regardless of the angle of the roll member RP, which makes it possible to prevent the paper P from loosening, prevent transport errors, and so on, which in turn makes it possible to suppress a degradation in the quality of the printed image.

In addition, in the first working example, the load is measured while actually rotating the roll member RP a full rotation, and thus more accurate average values aveTiL and aveTiH and correction amounts Tir can be calculated based on a greater number of loads (measurement values Ti) than in the working examples that will be mentioned later.

Furthermore, the CPU 11 obtains the control value QI outputted from the integrating element within the PID computation unit 130*a* during the constant velocity period as the load (in other words, measures the load during the constant velocity period). Accordingly, the load occurring when the roll motor 23 is driven at a specified velocity (VL, VH, or the like) can be obtained. As a result, accurate average values aveTiL and aveTiH, correction amounts Tir, and so on can be obtained in accordance with each velocity. Accordingly, it is preferable to divide a single rotation of the roll member RP into N times (here, eight times) so that the constant velocity period occurs during a period in which the roll member RP rotates 1/N rotation.

Measurement Process

Second Working Example

Figure 7A:
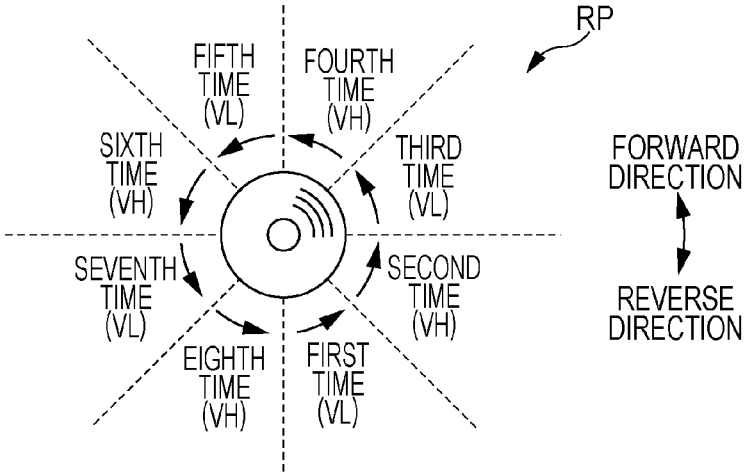
FIG. 7A is a diagram illustrating a relationship among the number of load measurements, a roll member rotation amount, and a roll motor rotational velocity.
Figure 7B:
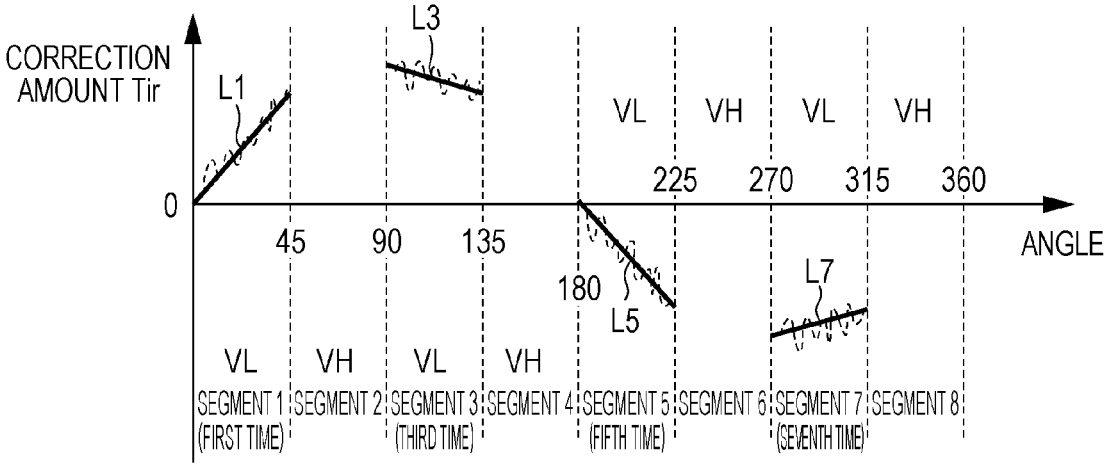
FIGS. 7B and 7C are diagrams illustrating processes for calculating approximation lines.
Figure 7C:
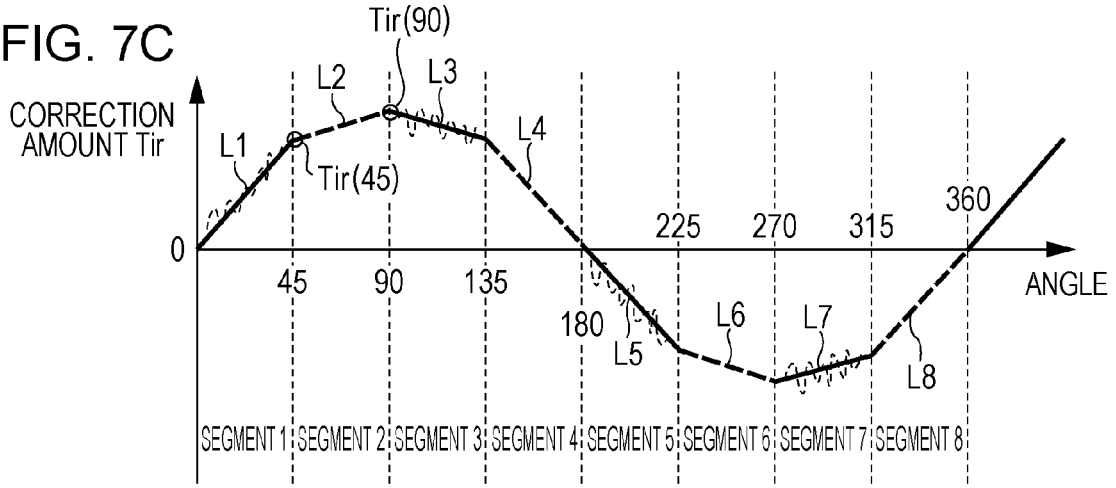

FIG. 7A is a diagram illustrating a relationship among the number of load measurements, the rotation amount of the roll member RP, and the rotational velocity of the roll motor 23 according to a second working example, and FIGS. 7B and 7C are diagrams illustrating processes for calculating approximation lines L1 to L8 of load fluctuations. In FIGS. 7B and 7C, the horizontal axes represent the angle of the roll member RP, whereas the vertical axes represent correction amounts. In the second working example, a process for measuring the load while rotating the roll member RP ⅛ rotation in the forward direction during driving at the low velocity VL and a process for measuring the load while rotating the roll member RP ⅛ rotation in the forward direction during driving at a high velocity VH are repeated in an alternating manner, consequently rotating the roll member RP one full rotation.

To describe in more detail, the CPU 11 rotates the roll member RP ⅛ rotation in the forward direction by driving the roll motor 23 at a set velocity using the PID computation unit 130*a* while the PF motor 43 is stopped, and measures a load during that period. As shown in FIG. 7A, the CPU 11 sets the set velocity to the low velocity VL when measuring the load during odd-numbered times (the first, third, fifth, and seventh times), and sets the set velocity to the high velocity VH when measuring the load during even-numbered times (the second, fourth, sixth, and eighth times). Note that in the second working example as well, the control value QI outputted from the integrating element during the constant velocity period (see FIG. 5A) is taken as the load, and the measurement value Ti obtained when measuring the load for the Nth time is taken as the measurement value Ti of the segment N.

Next, the CPU 11 rotates the roll member RP ⅛ rotation in the reverse direction by driving the roll motor 23 while the PF motor 43 is stopped, and then rotates the roll member RP ⅛ rotation in the forward direction while transporting the paper P downstream in the transport direction using the transport roller pair 41 by driving the PF motor 43 and the roll motor 23. By doing so, the phase of the roll member RP can be shifted without causing the paper P to sag around the roll member RP. The CPU 11 repeats the aforementioned processing eight times. One roll member rotations' worth of the paper P is transported downstream by the transport roller pair 41 as a result of the eight times the stated processing is carried out.

As a result, load measurement results during driving at the low velocity VL are obtained for the odd-numbered segments (segments 1, 3, 5, and 7) (odd-numbered measurement results), and load measurement results during driving at the high velocity VH are obtained for the even-numbered segments (segments 2, 4, 6, and 8) (even-numbered measurement results). Then, the CPU 11 calculates an average value of the load measurement values Ti in the odd-numbered segments as the "low velocity load average value aveTiL", calculates an average value of the load measurement values Ti in the even-numbered segments as the "high velocity load average value aveTiH", and obtains the relationship between the load and the rotational velocity (FIG. 3A).

Next, the CPU 11 calculates the correction amount Tir(θ) for the load at each angle θ of the roll member RP during driving at the low velocity VL. To do so, the CPU 11 subtracts the low velocity load average value aveTiL from the measurement value Ti of the load obtained during driving at the low velocity VL (Tir(θ)=Ti(θ)−aveTiL). However, in the second working example, driving at the low velocity VL is only carried out when measuring the load during the odd-numbered times, and thus as shown in FIG. 7B, the correction amount Tir is only calculated for the odd-numbered segments. Accordingly, the CPU 11 first calculates approximation lines (L1, L3, L5, and L7) for each of the four segments using the least-squares method, based on the correction amounts Tir in the odd-numbered segments.

After this, as shown in FIG. 7C, the CPU 11 calculates a straight line connecting the end (example: Tir(45)) of a approximation line of the segment (example: L1) before a given even-numbered segment (example: segment 2) to the beginning (example: Tir (90)) of the approximation line of the following segment (example: L3) as the approximation line of that even-numbered segment (example: L2). Note that the approximation line L8 of segment 8 is calculated using the approximation line L7 of segment 7 and the approximation line L1 of segment 1. In other words, the correction amounts Tir for angles (segments) for which the load was not measured during driving at the low velocity VL are interpolated. As a result, the eight approximation lines L1 to L8 for all of the segments are calculated. Although this working example describes interpolating the approximation lines for the even-numbered segments based on the approximation lines of the odd-numbered segments, the example is not limited thereto. For example, the data of the even-numbered segments may be interpolated based on the data of the odd-numbered segments (the measurement values Ti, the correction amounts Tir, or the like), and the approximation lines may then be calculated based on the interpolated data.

Finally, the CPU 11 stores the eight calculated approximation lines L1 to L8 in the memory 12, and takes up one roll member rotation's worth of the paper P onto the roll member RP. As a result, the measurement process according to the second working example ends, and the printer 1 enters a state in which printing can be carried out.

As described above, in the second working example, the CPU 11 executes a process for measuring the load when transporting the paper P while rotating the roll member RP ⅛ rotation (1/N rotation) in the forward direction by driving the roll motor 23 while the PF motor 43 is stopped, and after this process, executes a process for first rotating the roll member RP ⅛ rotation in the reverse direction by driving the roll motor 23 while the PF motor 43 is stopped and then rotating the roll member RP ⅛ rotation in the forward direction while transporting the paper P downstream by driving the PF motor 43 and the roll motor 23, performing these processes eight times (N/2 times=executing processes four or more times). Meanwhile, the CPU 11 sets the velocity of the roll motor 23 for rotating the roll member RP ⅛ rotation when measuring the load to the low velocity VL (a first velocity) and a higher velocity than the low velocity VL (a second velocity) in an alternating manner.

Accordingly, sagging of the paper P occurring around the roll member RP can be suppressed. In addition, the load fluctuations (FIG. 6A) occurring when the roll member RP is rotated a single rotation by driving the roll motor 23 at the low velocity VL (the velocity used in an actual printing process) can be obtained every ⅛ rotation (that is, every 45°), without driving the PF motor 43. Accordingly, by interpolating the correction amounts Tir (approximation lines) for loads that have not been measured, the correction amounts Tir for the loads at each angle θ of the roll member RP during driving at the low velocity VL can be obtained, as shown in FIG. 7C. By controlling the driving of the roll motor 23 at the actual motor output value Dx that incorporates the correction amount Tir, the influence of load fluctuations resulting from differences in the angle of the roll member RP can be further reduced.

Incidentally, in the example illustrated in FIG. 6A above, a comparatively large load is measured during the periods in which the angle of the roll member RP is at 0 to 180°, whereas a comparatively small load is measured during the periods in which angle is at 180 to 360°. In this case, if, for example, the roll member RP is driven at the low velocity VL during the first to fourth load measurements and the roll member RP is driven at the high velocity VH during the fifth to eighth load measurements, the load measured during the driving at the low velocity VL will be skewed toward a high value, and the load measured during the driving at the high velocity VH will be skewed toward a low value. Accordingly, the velocity of the roll motor 23 during load measurement is set to the low velocity VL and the high velocity VH in an alternating manner, as described in the second working example.

By doing so, the average values (aveTiL, aveTiH) can be prevented from being calculated using skewed loads based only on some angles of the roll member RP. Accordingly, the actual motor output value Dx can be calculated based on an accurate relationship between the load and the rotational velocity during driving control of the roll motor 23, which makes it possible to reduce the influence of load fluctuations resulting from differences in the angle of the roll member RP. In addition, the segments in which the correction amounts Tir (approximation lines) are interpolated for the loads that were not measured can be shortened, which makes it possible to calculate accurate correction amounts Tir.

Furthermore, the number of load measurements is lower in the second working example (FIG. 7A) than in the first working example (FIG. 5C), and thus the time required for the measurement process can be reduced. Furthermore, although two roll member rotations' worth of the paper P is transported downstream by the transport roller pair 41 in the first working example, in the second working example, only one roll member rotation's worth of the paper P is transported downstream. Accordingly, the transport amount of the paper P, the amount of paper P that is taken up by the roll member RP, and so on can be reduced (by half). As a result, in the second working example, slanting (skew), loosening, and so on of the paper P, which is a risk when transporting and when taking up the paper P, can be reduced.

Measurement Process

Third Working Example

Figure 8:
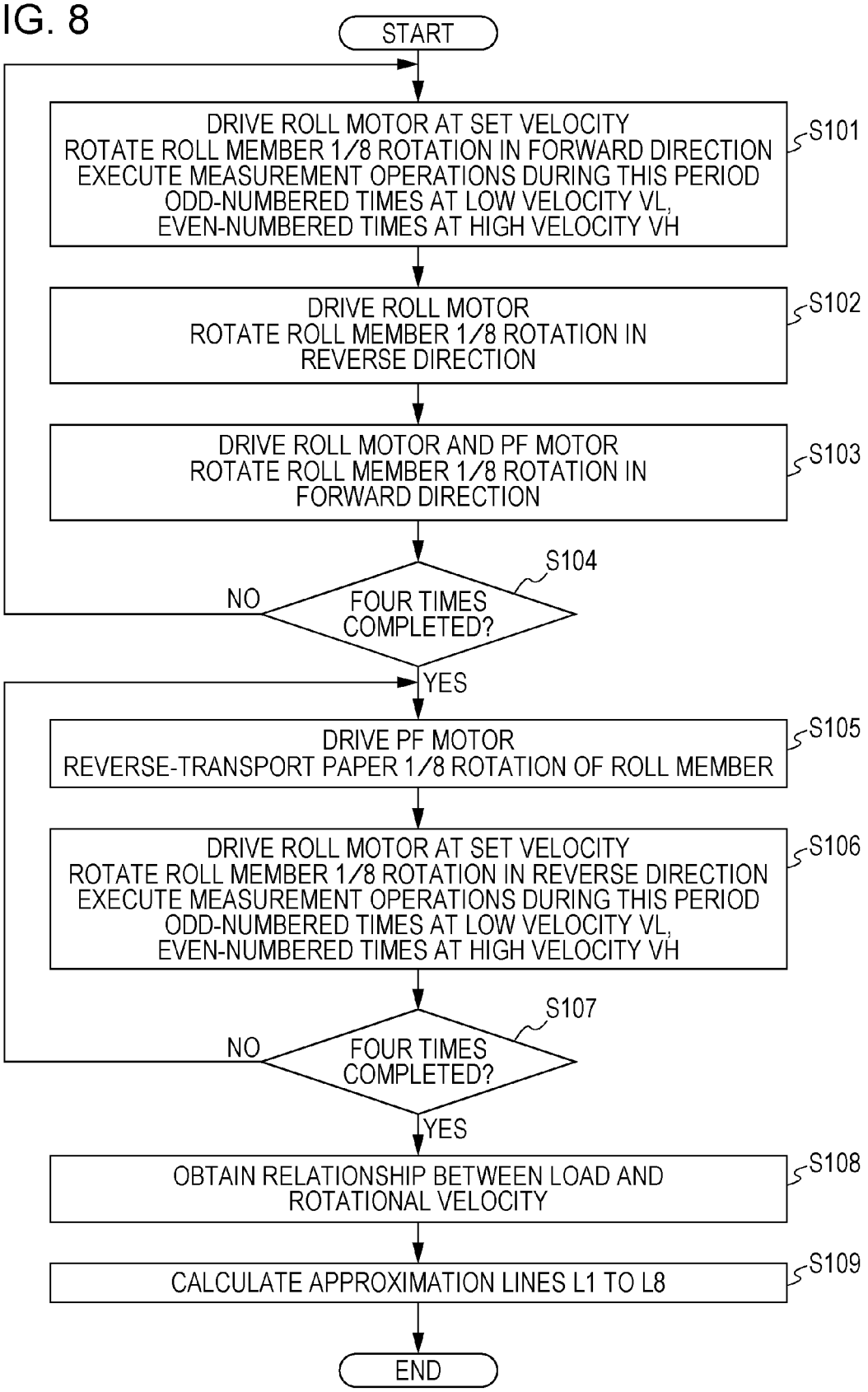
FIG. 8 is a flowchart illustrating a measurement process according to a third working example.
Figure 9A:
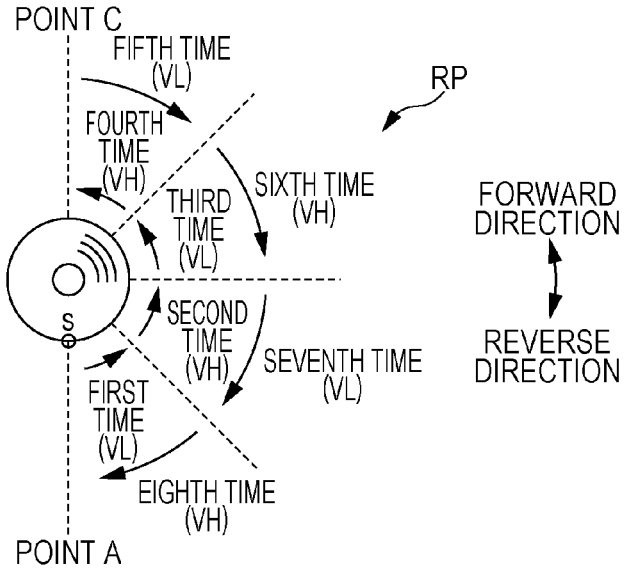
FIG. 9A is a diagram illustrating a relationship among the number of load measurements, a roll member rotation amount, and a roll motor rotational velocity.
Figure 9B:
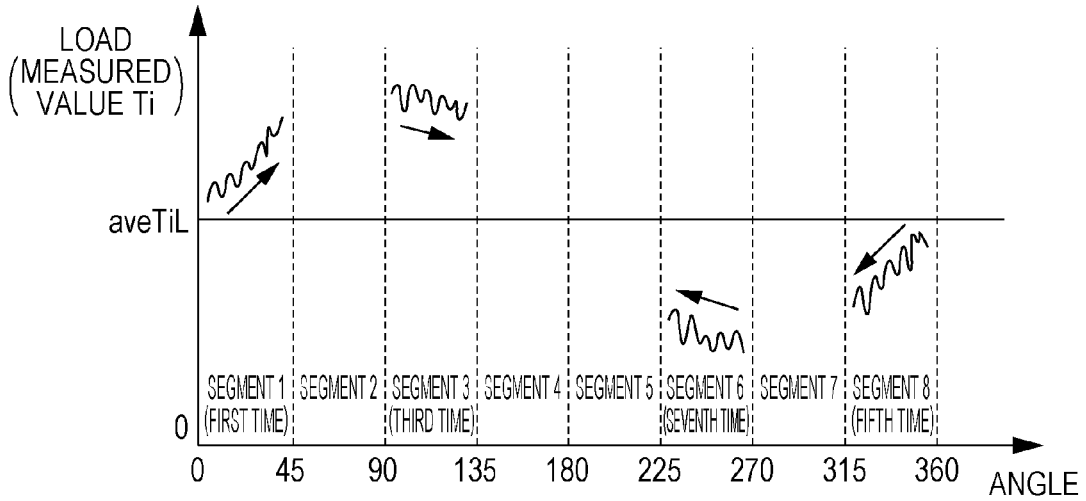
FIGS. 9B and 9C are diagrams illustrating processes for calculating approximation lines.
Figure 9C:
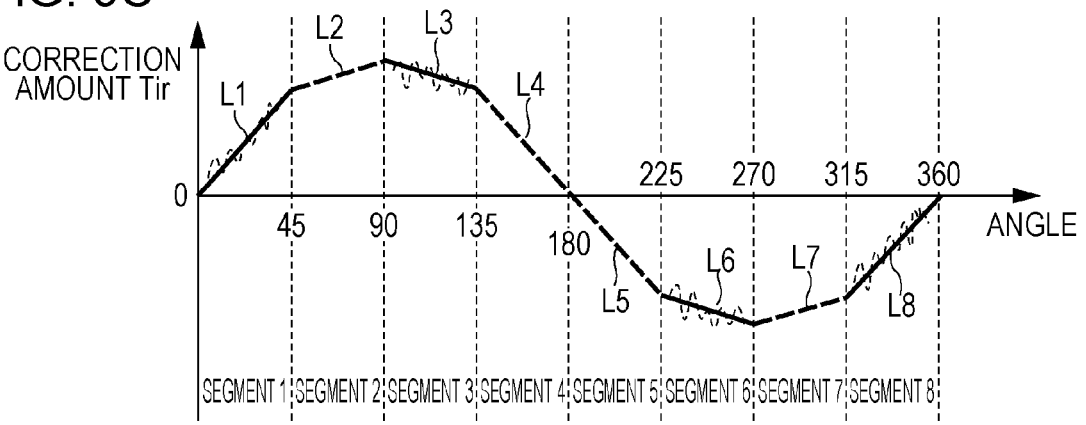

FIG. 8 is a flowchart illustrating a measurement process according to a third working example. FIG. 9A is a diagram illustrating the relationship among the number of load measurements, the rotation amount of the roll member RP, and the rotational velocity of the roll motor 23, whereas FIGS. 9B and 9C are diagrams illustrating processes for calculating the approximation lines L1 to L8 for the load fluctuation. In FIG. 9B, the horizontal axis represents an angle and the vertical axis represents a measurement value, whereas in FIG. 9C, the horizontal axis represents an angle and the vertical axis represents a correction amount. In the third working example, the load is measured by first rotating the roll member RP ½ rotation in the forward direction and then rotating the roll member RP ½ rotation in the reverse direction.

To describe in more detail, the CPU 11 rotates the roll member RP ⅛ rotation in the forward direction by driving the roll motor 23 at a set velocity using the PID computation unit 130*a* while the PF motor 43 is stopped, and measures a load during that period (S101). As shown in FIG. 9A, the set velocity is set to the low velocity VL when measuring the load during odd-numbered times (the first and third times), and the set velocity is set to the high velocity VH when measuring the load during even-numbered times (the second and fourth times). Note that in the third working example as well, the control value QI outputted from the integrating element during the constant velocity period (see FIG. 5A) is taken as the load.

Next, the CPU 11 rotates the roll member RP ⅛ rotation in the reverse direction by driving the roll motor 23 while the PF motor 43 is stopped (S102), and then rotates the roll member RP ⅛ rotation in the forward direction while transporting the paper P downstream in the transport direction using the transport roller pair 41 by driving the PF motor 43 and the roll motor 23 (S103). By doing so, the phase of the roll member RP can be shifted without causing the paper P to sag around the roll member RP. The CPU 11 then repeats the aforementioned processing (S101 to S103 in FIG. 8) four times (S104). At this time, ½ roll member rotations' worth of the paper P is transported downstream by the transport roller pair 41.

Thereafter, by driving the PF motor 43 while the roll motor 23 is stopped, the CPU 11 causes the transport roller pair 41 to reverse-transport, in the upstream direction, an amount of the paper P that is taken up when the roll member RP is rotated ⅛ rotation in the reverse direction (S105). As a result, ⅛ roll member rotations' worth of the paper P sags around the roll member RP.

While the paper P is in this loose state, the CPU 11 measures the load while rotating the roll member RP ⅛ rotation in the reverse direction by driving the roll motor 23 at the set velocity using the PID computation unit 130*a*, without driving the PF motor 43 (S106). As a result, the sagging of the paper P is eliminated, and the phase of the roll member RP is shifted. The CPU 11 then repeats the aforementioned processing (S105 to S106 in FIG. 8) four times (S107). Note that as shown in FIG. 9A, the low velocity VL is set when measuring the load during odd-numbered times (the fifth and seventh times), and the high velocity VH is set when measuring the load during even-numbered times (the sixth and eighth times).

As a result, the roll member RP is rotated ½ rotation in the reverse direction, and the roll member RP is returned to the state occurring before the start of the measurement process (that is, the reference point s of the roll member RP is returned to the position of the point A). In addition, the ½ roll member rotations' worth of the paper P that was transported downstream in the former half of the processing (S101 to S103) is taken up onto the roll member RP. Accordingly, in the third working example, it is not necessary to execute a process for taking up the paper P onto the roll member RP at the end. Then, the CPU 11 calculates an average value of the load measurement values Ti in the odd-numbered segments as the "low velocity load average value aveTiL", calculates an average value of the load measurement values Ti in the even-numbered segments as the "high velocity load average value aveTiH", and obtains the relationship between the load and the rotational velocity (FIG. 3A) (S108).

Next, the CPU 11 calculates the correction amount Tir(θ) for the load at each angle θ of the roll member RP during driving at the low velocity VL. However, in the third working example, the roll member RP is rotated in the reverse direction partway through. Accordingly, as shown in FIG. 9B, the measurement value Ti when the roll member RP is rotated so that the reference point s moves from the point A by the angle θ in the forward direction is taken as an "angle θ measurement value", and the measurement value Ti when the roll member RP is rotated so that the reference point s moves from a point C by the angle θ in the reverse direction is taken as an "angle 360−θ measurement value". In other words, the loads obtained through the first and third measurements are taken as measurement values for segment 1 and segment 3, respectively, the load obtained through the fifth measurement is taken as a measurement value for segment 8, and the load obtained through the seventh measurement is taken as a measurement value for segment 6.

The CPU 11 then calculates the correction amounts Tir by subtracting the low velocity load average value aveTiL from the measurement values Ti of segments 1, 3, 6, and 8, and based on those correction amounts Tir, calculates four approximation lines for each segment through the least-squares method (L1, L3, L6, and L8). Thereafter, the CPU 11 calculates, for the segments that do not have measurement values Ti during driving at the low velocity VL (that is, segments 2, 4, 5, and 7), a straight line connecting the end of an approximation line of the segment (example: L3) before the stated segment (example: segment 4, segment 5) to the beginning of the approximation line of the following segment (example: L6) as the approximation line of the stated segments (example: L4, L5). As a result, the eight approximation lines L1 to L8 for all of the segments are calculated (S109). Finally, the CPU 11 stores the eight calculated approximation lines L1 to L8 in the memory 12. As a result, the measurement process according to the third working example ends, and the printer 1 enters a state in which printing can be carried out.

Figure 10A:
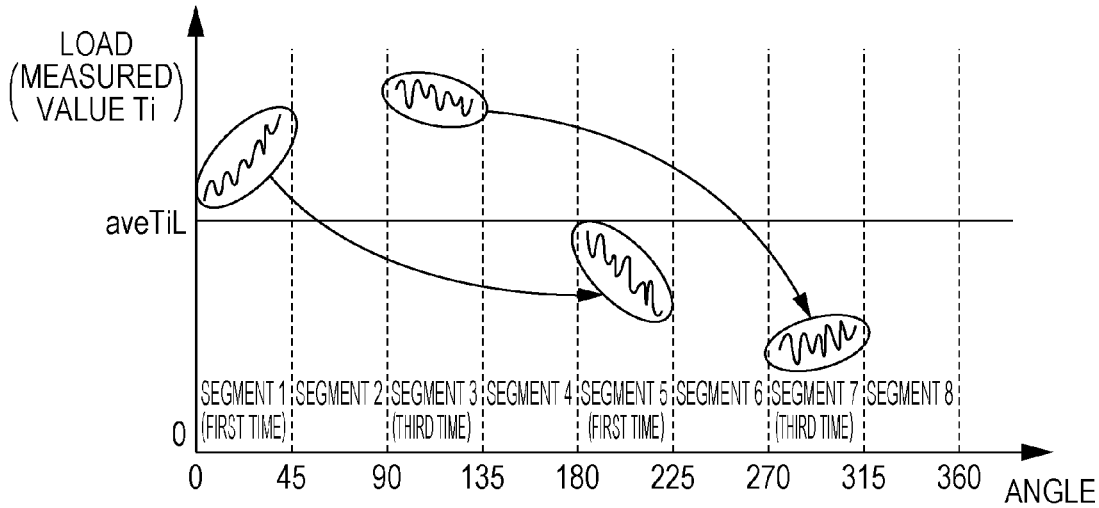
FIGS. 10A and 10B are diagrams illustrating other processes for calculating approximation lines.
Figure 10B:
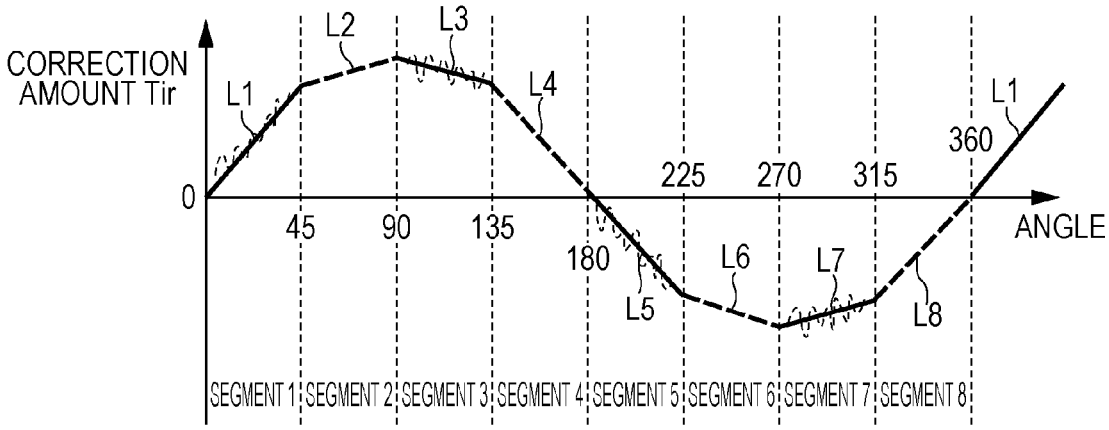

FIGS. 10A and 10B are diagrams illustrating another process for calculating the approximation lines L1 to L8. Note that the horizontal axes in FIGS. 10A and 10B represent the angle of the roll member RP, the vertical axis in FIG. 10A represents the measurement value Ti of the load, and the vertical axis in FIG. 10B represents the correction amount Tir. In the aforementioned working example, the load obtained during the fifth measurement is taken as the measurement value for segment 8, and the load obtained during the seventh measurement is taken as the measurement value for segment 6; however, the example is not limited thereto. For example, as shown in FIG. 10A, the measurement value Ti of segment 1 (the first measurement value Ti) may be taken as the measurement value Ti for segment 5, which is the segment 180° (½ rotation) ahead of segment 1, and the measurement value Ti of segment 3 (the third measurement value Ti) may be taken as the measurement value Ti for segment 7, which is the segment 180° ahead of segment 3. However, data in which the measurement values Ti of segments 1 and 3 are inverted with the low velocity load average value aveTiL are taken as the measurement values Ti of segments 5 and 7. Specifically, values obtained by adding the average value aveTiL to values obtained by subtracting the measurement values Ti of segments 1 and 3 from the average value aveTiL are taken as the measurement values Ti for segments 5 and 7. Thereafter, in the same manner, it is preferable to calculate the correction amounts Tir from the measurement values Ti of the odd-numbered segments, calculate the approximation lines based on the correction amounts Tir, and interpolate the approximation lines for the even-numbered segments based on the approximation lines of the odd-numbered segments, as shown in FIG. 10B.

As described above, in the third working example, the CPU 11 executes a process for measuring the load when transporting the paper P while rotating the roll member RP ⅛ rotation (1/N rotation) in the forward direction by driving the roll motor 23 while the PF motor 43 is stopped, and after this process, executes a process for first rotating the roll member RP ⅛ rotation in the reverse direction by driving the roll motor 23 while the PF motor 43 is stopped and then rotating the roll member RP ⅛ rotation in the forward direction while transporting the paper P downstream by driving the PF motor 43 and the roll motor 23, performing these processes four times (N/2 times).

After that, in the third working example, the CPU 11 executes a process for causing the transport roller pair 41 (the transport unit) to transport, upstream in the transport direction, an amount of the paper P that is taken up when the roll member RP is rotated ⅛ rotation (1/N rotation) in the reverse direction by driving the PF motor 43 (the second driving unit) while the roll motor 23 (first driving unit) is stopped (S105, a third process), and after this process, executes a process for measuring the load while rotating the roll member RP ⅛ rotation in the reverse direction by driving the roll motor 23 while the PF motor 43 is stopped (S106, a fourth process), performing these processes four times.

Accordingly, sagging of the paper P occurring around the roll member RP can be suppressed. In addition, the load fluctuations (FIG. 6A) occurring when the roll member RP is rotated a single rotation by driving the roll motor 23 at the low velocity VL (the velocity used in an actual printing process) can be obtained in each segment 1 or segment 2, without driving the PF motor 43. Accordingly, by interpolating the correction amounts Tir (approximation lines) for loads that have not been measured, the correction amounts Tir for the loads at each angle θ of the roll member RP during driving at the low velocity VL can be obtained, as shown in FIG. 9C, 10B, and so on. By controlling the driving of the roll motor 23 at the actual motor output value Dx that incorporates the correction amount Tir, the influence of load fluctuations resulting from differences in the angle of the roll member RP can be further reduced.

In addition, as in the second working example, the velocity of the roll motor 23 during load measurement is set to the low velocity VL and the high velocity VH in an alternating manner in the third working example as well. Accordingly, it is possible to calculate the actual motor output value Dx based not on a skewed average value for the loads, but based instead on an accurate average value (relationship between the load and the rotational velocity), which in turn makes it possible to reduce the influence of load fluctuations resulting from differences in the angle of the roll member RP. In addition, the segments in which the correction amounts Tir are interpolated for the loads that were not measured can be shortened, which makes it possible to calculate accurate correction amounts Tir.

Furthermore, the number of load measurements is lower in the third working example (FIG. 9A) than in the first working example (FIG. 5C), and thus the time required for the measurement process can be reduced. In addition, in the third working example, only ½ roll member rotations' worth of the paper P is transported downstream by the transport roller pair 41. Accordingly, in the third working example, the transport amount of the paper P, the amount of the paper P that is taken up on the roll member RP, and so on can be reduced more than in the first working example, the second working example, and so on, which in turn makes it possible to reduce slanting (skew), loosening, and so on of the paper P. In addition, because the paper P is taken up on the roll member RP in the latter half of the processing (S105, S106) in the third working example, it is not necessary to execute a process for taking up the paper P separately from the load measurement, which in turn makes it possible to shorten the time required for the measurement process.

Measurement Process

Variations

Although the aforementioned working examples describe rotating the roll member RP ⅛ rotation when measuring the load, the invention is not limited thereto, and for example, the roll member RP may be rotated ¼ rotation, 1/12 rotation, or the like. However, it is preferable to set the rotation amount so that the constant velocity period is present when the roll member RP rotates 1/N rotation. In addition, the rotation amount may be set so that the paper P that sags around the roll member RP does not make contact with peripheral members, and the rotation amount may be set so that the paper P that sags around the roll member RP does not cause the user to mistakenly think that a problem has occurred.

In addition, although the aforementioned working examples describe driving the roll motor 23 at a velocity used when carrying out an actual printing process (VL) and at a higher velocity (VH), the invention is not limited thereto, and for example, the roll motor 23 may be driven at a velocity used when carrying out an actual printing process (VH) and at a lower velocity (VL). In addition, although the aforementioned second and third working examples describe using the low velocity VL during odd-numbered measurements and the high velocity VH during even-numbered measurements, the invention is not limited thereto, and the high velocity VH may be used during odd-numbered measurements and the low velocity VL may be used during even-numbered measurements. In addition, the invention is not limited to the roll motor 23 changing velocities (VL, VH) in an alternating manner, and for example, the roll motor 23 may be driven at the same velocity two times in a row, or the roll motor 23 may be driven continuously at the same velocity for half a rotation.

In addition, although the first working example describes rotating the roll member RP in the forward direction one full rotation over eight times through driving at the low velocity VL and then rotating the roll member RP in the forward direction one full rotation over eight times through driving at the high velocity VH, the invention is not limited thereto. For example, the roll member RP may first be rotated one rotation through driving at the high velocity VH. Furthermore, for example, after rotating the roll member RP one rotation through driving at the low velocity VL, the load may be measured while rotating the roll member RP in the reverse direction through driving at the high velocity VH, as in the third working example (S105 to S106 of FIG. 8).

In addition, although the first working example describes executing a process for measuring the load eight times while rotating the roll member RP ⅛ rotation and consequently rotating the roll member RP one rotation, the invention is not limited thereto. For example, the process for measuring the load may be executed N/2 times while rotating the roll member RP 1/N rotations and consequently rotating the roll member RP only ½ rotation. An apex of the load fluctuation (that is, a maximum value or a minimum value) can be obtained as long as the roll member RP is rotated at least ½ rotation. For example, data from the maximum value to the minimum value of the load fluctuation can be obtained by inverting data prior to the apex of the data obtained by rotating the roll member RP ½ rotation (that is, the measurement value Ti for the load) and connecting the inverted data to the end of the stated data that was obtained. Accordingly, the average value can be prevented from being calculated based on a skewed value for the load, and the correction amount Tir for the load fluctuation occurring when the roll member RP is rotated one rotation can be obtained.

Furthermore, although the third working example describes the number of times the roll member RP is rotated in the forward direction ⅛ rotation (four times) as being the same as the number of times the roll member RP is rotated in the reverse direction (four times), the invention is not limited thereto. For example, the number of times the roll member RP is rotated ⅛ rotation in the forward direction may be set to five times, and the number of times the roll member RP is rotated in the reverse direction may be set to three times.

Operations of Printer 1

When the printer 1 receives a print job from the computer 50, the aforementioned measurement process is executed by the CPU 11, and the relationship between the load and the rotational velocity (FIG. 3A) and the correction amounts Tir (the approximation lines L1 to L8) for the load fluctuation over a single rotation of the roll member are found. Thereafter, the controller 10 repeats a transport operation for transporting the paper P downstream by driving the PF motor 43 and the roll motor 23, and an ejection operation for ejecting ink toward the paper P while moving the print head 33 in the movement direction, in an alternating manner, printing an image onto the paper P as a result. Although the measurement process is described as being carried out prior to the start of the print job, the invention is not limited thereto, and, for example, the measurement process may be carried out when the printer 1 is turned on, or the measurement process may be carried out every plurality of print jobs, every predetermined amount of time, or the like.

In the transport operation, the PID computation unit 140*a* (FIG. 2) within the PF motor control unit 140 controls the velocity of the PF motor 43 through PID control according to a velocity table such as that shown in FIG. 5A. Meanwhile, the output computation unit 130*b* within the roll motor control unit 130 calculates the "actual motor output value Dx (duty value during PWM control)" through the following Formula 7, based on the rotational velocity Vn of the roll motor 23 detected through the pulse signal from the rotation detection unit 24 (in the constant velocity period, the low velocity VL) and the angle θ of the roll member RP, the relationship between the load and the rotational velocity (FIG. 3A), and the correction amounts Tir (the approximation lines L1 to L8) based on the angles θ of the roll member RP. The driving of the roll motor 23 is then controlled according to the actual motor output value Dx calculated by the output computation unit 130*b*. Note that Duty(r0) and Duty(f) in Formula 7 are the same as in the comparative example.

$$Dx=\text{Duty}(r0)-\text{Duty}(f)+Tir(\theta) \quad \text{(Formula 7)}$$

In this example, through the aforementioned measurement process, an accurate "relationship between the load and the rotational velocity (FIG. 3A)" in which the influence of the angle θ of the roll member RP has been reduced is obtained, rather than a skewed load based only on some of the angles of the roll member RP. Accordingly, it is possible to calculate the actual motor output value Dx in which the influence of load fluctuations resulting from differences in the angle θ of the roll member RP has been reduced.

Furthermore, in this example, the actual motor output value Dx' (Formula 4) according to the comparative example is corrected using the correction amount Tir(θ) for the load at the angle θ of the roll member RP. Accordingly, the controller 10 manages the angle of the roll member RP at the point in time at which the measurement process is started (here, the angle where the reference point s of the roll member RP is positioned at the point A) and the current angle θ of the roll member RP (the angle at which the reference point s of the roll member RP is rotated in the forward direction from the point A). Then, during the transport operation, the output computation unit 130*b* calculates the correction amount Tir (θ) based on the current angle θ of the roll member RP and the approximation lines L1 to L8 stored in the memory 12. For example, in the case where the current angle θ of the roll member RP is 120°, as shown in FIG. 6C, the output computation unit 130*b* calculates the correction amount Tir (120) from the approximation line L3 in segment 3. Note that in this example, the correction amount Tir(θ) is also calculated for the acceleration period and the deceleration period as well, based on the approximation lines L1 to L8 found in accordance with driving at the low velocity VL.

For example, in FIG. 6A, a measurement value Ti for the load that is greater than the low velocity load average value aveTiL is obtained during the period when the angle of the roll member RP is 0 to 180°, and a measurement value Ti for the load that is lower than the low velocity load average value aveTiL is obtained during the period when the angle of the roll member RP is 180 to 360°. In this case, as shown in FIG. 6C, the actual motor output value Dx is corrected to a higher value using the positive correction amount Tir(θ) during the period when the angle of the roll member RP is 0 to 180°, thus increasing the driving force of the roll motor 23 (the roll member RP). Conversely, the actual motor output value Dx is corrected to a lower value using the negative correction amount Tir(θ) during the period when the angle of the roll member RP is 180 to 360°, thus reducing the driving force of the roll motor 23.

In this manner, the correction amount Tir(θ) for the load based on the angle θ of the roll member RP is added to a value (Dx') obtained by subtracting the Duty(F) required to cause the specified tension F to act on the paper P from the Duty(r0) required to drive the roll motor 23 at a given velocity Vn. Accordingly, it is possible to control the driving of the roll motor 23 using the actual motor output value Dx in which the influence of load fluctuations resulting from differences in the angle θ of the roll member RP has been reduced. As a result, the paper P can be transported while causing the specified tension F to act on the paper P. In other words, even if the roll member RP has sagged under its own weight, the loosening of the paper P, transport errors, and so on can be suppressed, which in turn makes it possible to prevent degradation in the quality of the printed image.

Variation

Driving Control of Roll Motor 23

Although the aforementioned example (Formula 7) adds the correction amount Tir(θ) for the load based on the angle θ of the roll member RP to the actual motor output value Dx' (Formula 4) according to the comparative example, the invention is not limited thereto. The actual motor output value Dx' may be calculated using the same Formula 4 as in the comparative example. In other words, the correction amount Tir (θ) for the load based on the angle θ of the roll member RP need not be added. Even in this case, by executing the measurement process according to the stated example, the actual motor output value Dx' is calculated based on the accurate "relationship between the load and the rotational velocity (FIG. 3A)" in which the influence of the angle θ of the roll member RP is reduced, rather than on a skewed load based only on some of the angles of the roll member RP. Accordingly, compared to the comparative example, in which the rotation amount of the roll member RP when measuring the load is ¼ rotation, the influence of load fluctuations resulting from differences in the angle of the roll member RP can be reduced when transporting the paper P.

Other Embodiments

The aforementioned embodiments have been provided to facilitate understanding of the invention and are not to be interpreted as limiting the invention in any way. Many variations and modifications can be made without departing from the essential spirit of the present invention, and thus all such variations and modifications also fall within the scope of the present invention.

Although the aforementioned embodiments describe a printer that repeats ejection operations for ejecting ink while moving a print head in a movement direction and transport operations for transporting paper in an alternating manner, the invention is not limited thereto. For example, the printer may include a fixed print head in which nozzles are arranged along the width direction of the paper, and may eject ink from the print head toward the paper while the paper moves in a direction orthogonal to the width direction. Alternatively, the printer may, for example, print images by repeating an operation for printing an image while moving a print head in the X direction, and an operation for moving the print head in the Y direction, relative to paper that has been transported to a print region, and by then transporting a section of the paper onto which an image has not yet been printed to the print region.

Although the aforementioned embodiments describe an ink jet printer as an example of the recording apparatus, the invention is not limited thereto. Any system may be used as long as images, text, patterns, or the like can be formed upon the roll member. Various types of printers may be used, such as gel jet printers, toner-based printers, dot impact printers, or the like. In addition, the printer 1 according to the aforementioned embodiments may be a part of a complex machine such as a facsimile device, a scanner device, a copier, or the like.

Although the aforementioned embodiments describe the PID computation unit performing PID control on the velocity, the invention is not limited thereto, and for example, PID control may be performed on positions. Furthermore, for example, the control performed on the PF motor 43 may be PID control.

What is claimed is:

1. A recording apparatus comprising:

a recording unit that records onto a medium;

a first driving unit that rotates a roll member around which the medium is wrapped;

a transport unit, located downstream from the roll member in a transport direction of the medium, that transports the medium;

a second driving unit that drives the transport unit; and a control unit that measures a load occurring when transporting the medium by changing the transport direction into any of a forward direction in which the medium is transported downstream or a reverse direction in which the medium is taken up onto the roll member.

2. The recording apparatus according to claim 1, wherein the control unit executes a first process for measuring the load while the second driving unit is stopped and after executing the first process, executes a second process while transporting the medium downstream by driving the first driving unit and the second driving unit.

3. The recording apparatus according to claim 1, wherein the control unit executes an acceleration process in which a velocity of the first driving unit accelerates to a constant velocity.

4. The recording apparatus according to claim 1, wherein the control unit sets a velocity at which the first driving unit rotates the roll member to a first velocity and to a second velocity in an alternating manner.

* * * * *